US008224205B2

(12) United States Patent
Tsumita et al.

(10) Patent No.: US 8,224,205 B2
(45) Date of Patent: Jul. 17, 2012

(54) POWDER STORAGE CONTAINER AND IMAGE FORMING APPARATUS USING THE SAME

(75) Inventors: Toshikazu Tsumita, Kanagawa (JP); Hiroaki Okuma, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 209 days.

(21) Appl. No.: 12/821,837

(22) Filed: Jun. 23, 2010

(65) Prior Publication Data

US 2011/0076061 A1 Mar. 31, 2011

(30) Foreign Application Priority Data

Sep. 25, 2009 (JP) ..... 2009-221026

(51) Int. Cl.
*G03G 15/04* (2006.01)
*G03G 15/08* (2006.01)

(52) U.S. Cl. ..... 399/119; 399/262

(58) Field of Classification Search ..... 399/119, 399/120, 252, 258, 260, 262
See application file for complete search history.

(56) References Cited

U.S. PATENT DOCUMENTS

2009/0129827 A1* 5/2009 Ichikawa et al. ..... 399/262

FOREIGN PATENT DOCUMENTS

| | | | |
|---|---|---|---|
| JP | 9-281784 | A | 10/1997 |
| JP | 2005-31229 | A | 2/2005 |
| JP | 2006-145873 | A | 6/2006 |
| JP | 4217920 | B1 | 2/2009 |

* cited by examiner

*Primary Examiner* — David Gray
*Assistant Examiner* — Frederick Wenderoth
(74) *Attorney, Agent, or Firm* — Sughrue Mion, PLLC

(57) ABSTRACT

A powder storage container includes a container body, an opening formed in a portion of the container body, an opening-and-closing cover, a cover holding frame, a protrusion portion provided in the opening-and-closing cover, a blocking portion provided in the cover holding frame, a position regulating protrusion protruding from the cover holding frame, and a disengagement suppressing protrusion provided in the opening-and-closing cover. When the opening-and-closing cover takes such an attitude that the opening-and-closing cover is swingably supported by a contact portion, serving as a fulcrum, between the disengagement suppressing protrusion and the cover holding frame and is arranged along the opening-and-closing operation direction, a distal end position of the protrusion portion is located in a position where the distal end position can be released from the blocking portion.

20 Claims, 25 Drawing Sheets

271
270
273
240
230
250
38
244
253
240
230
Unlock
250
38

POWDER STORAGE CONTAINER AND IMAGE FORMING APPARATUS USING THE SAME

CROSS-REFERENCE TO RELATED APPLICATIONS

This application is based on and claims priority under 35 USC 119 from Japanese Patent Application No. 2009-221026 filed Sep. 25, 2009.

BACKGROUND

Technical Field

The invention relates to a powder storage container and an image forming apparatus using the same.

SUMMARY

According to an aspect of the invention, a powder storage container is removably inserted into a container receiving portion of a chassis of an image forming apparatus. The container stores a powder therein. The container includes a container body, an opening, an opening-and-closing cover, a cover holding frame, a protrusion portion, a blocking portion, a position regulating protrusion, and a disengagement suppressing protrusion. The container body stores the powder therein. The opening is formed in a portion of the container body. The opening-and-closing cover blocks the opening. The cover holding frame holds the opening-and-closing cover so that the opening-and-closing cover is movable in an opening-and-closing direction between an opening position in which the opening is open and a closing position in which the opening is closed. The protrusion portion is provided in the opening-and-closing cover. The protrusion portion protrudes towards the cover holding frame in a direction intersecting the opening-and-closing direction in a state where the opening-and-closing cover is located in the closing position. The blocking portion is provided in the cover holding frame. In the state where the opening-and-closing cover is located in the closing position, the blocking portion is located in a position where the blocking portion intersects a straight line which is drawn along the opening-and-closing direction from a distal end position, in a direction perpendicular to the opening-and-closing direction, of the protrusion portion, so that the blocking portion is spaced apart from the protrusion portion. When the opening-and-closing cover moves in the opening-and-closing direction from the closing position toward the opening position and reaches a certain intermediate position in which it is not started to open the opening, the blocking portion is in contact with the protrusion portion and blocks the protrusion portion of the opening-and-closing cover, which moves toward the opening position. The position regulating protrusion protrudes from the cover holding frame in a direction which intersects the opening-and-closing direction. When the opening-and-closing cover moves toward the closing position from a position where the protrusion portion and the blocking portion come into contact with each other, the position regulating protrusion comes into contact with the opening-and-closing cover to move the opening-and-closing cover in the direction, which intersects the opening-and-closing direction, and regulates a position of the opening-and-closing cover in the direction intersecting the opening-and-closing direction so that the blocking portion intersects the straight line, which is drawn along the opening-and-closing direction from the distal end position of the protrusion portion. The disengagement suppressing protrusion is provided in the opening-and-closing cover on an opposite side to the protrusion portion in the direction, which intersects the opening-and-closing direction of the opening-and-closing cover. In the state where the opening-and-closing cover is located in the closing position, the disengagement suppressing protrusion protrudes from the opening-and-closing cover toward the cover holding frame with a smaller amount of protrusion than the position regulating protrusion. When the opening-and-closing cover moves along the opening-and-closing direction from the closing position to a position where the position regulating protrusion is located outside the opening-and-closing cover and then moves toward the cover holding frame along the intersection direction, the disengagement suppressing protrusion is in contact with the cover holding frame.

BRIEF DESCRIPTION OF THE DRAWINGS

Exemplary embodiments of the invention will be described in detail based on the following figures, wherein.

DETAILED DESCRIPTION

<Outline of One Exemplary Embodiment>

Figure 1A:
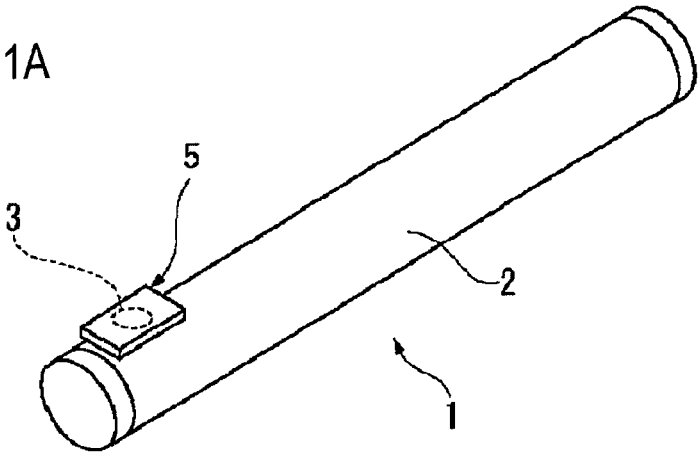
FIG. 1A is an explanatory diagram showing an outline of a developer storage container according to an exemplary embodiment of the invention.

FIG. 1A shows an outline of a developer storage container to which an exemplary embodiment of the invention is applied.

In this drawing, a developer storage container 1 is configured to be removably inserted into a container receiving portion of a chassis of an image forming apparatus, and stores a developer (an example of a powder) therein. The developer storage container includes a container body 2, an opening 3, an opening-and-closing cover 5 and a cover holding frame 6 (see FIG. 1B). The container body 2 stores a developer therein. The opening 3 is formed in a portion of the container body 2. The opening-and-closing cover 5 is configured to block (cover) the opening 3. The cover holding frame 6 holds the opening-and-closing cover 5 so that the opening-and-closing cover 5 is movable in an opening-and-closing direction between an opening position D in which the opening 3 is opened and a closing position A in which the opening 3 is closed.

Figure 1B:
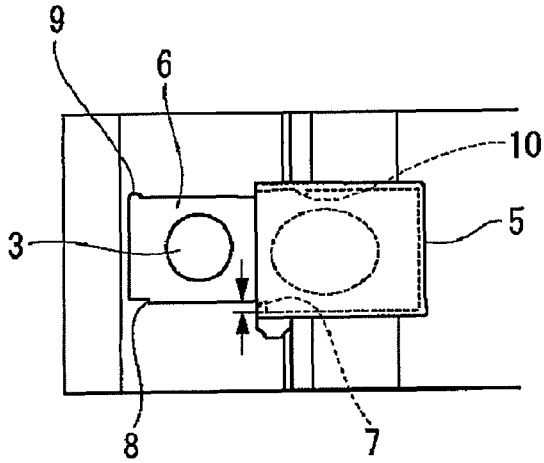
FIG. 1B is an explanatory diagram showing main parts of the developer storage container.
Figure 1C:
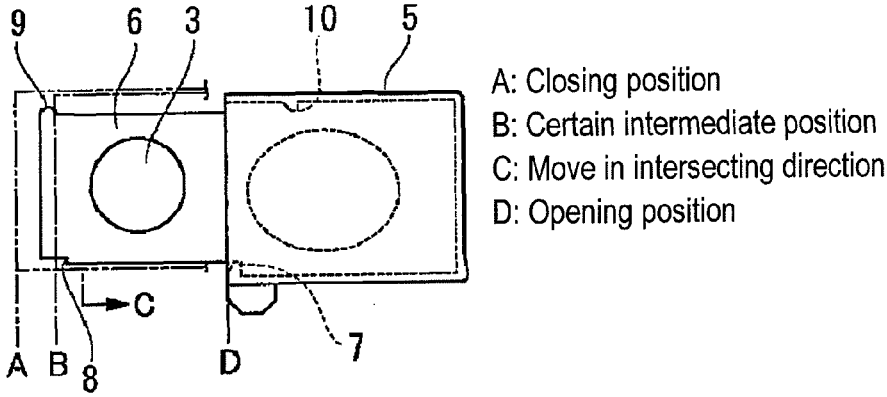
FIG. 1C is an explanatory diagram showing an opening/closing operation of an opening-and-closing cover.

In particular, in this exemplary embodiment, the developer storage container 1, as shown in FIGS. 1B and 1C, has a protrusion portion 7, a blocking portion 8, a position regulating protrusion 9, and a disengagement suppressing protrusion 10. The protrusion portion 7 is provided in the opening-and-closing cover 5. The protrusion portion 7 protrudes towards the cover holding frame 6 in a direction intersecting the opening-and-closing direction in a state where the opening-and-closing cover 5 is located in the closing position A. The blocking portion 8 is provided in the cover holding frame 6. In a state where the opening-and-closing cover 5 is located in the closing position A, the blocking portion 8 is located in a position where the blocking portion 8 intersects a straight line which is drawn along the opening-and-closing direction from a distal end position, in a direction perpendicular to the opening-and-closing direction, of the protrusion portion 7, so that the blocking portion 8 is spaced apart from the protrusion portion 7. When the opening-and-closing cover 5 moves in the opening-and-closing direction from the closing position A toward the opening position D and reaches a certain intermediate position B in which it is not started to open the opening 3, the blocking portion 8 is in contact with the protrusion portion 7 and blocks the protrusion portion 7 of the opening-and-closing cover 5, which moves toward the opening position. The position regulating protrusion 9 protrudes from the cover holding frame 6 in a direction that intersects the opening-and-closing direction. When the opening-and-closing cover 5 moves toward the closing position A from a position where the protrusion portion 7 and the blocking portion 8 come into contact with each other, the position regulating protrusion 9 comes into contact with the opening-and-closing cover 5 to move the opening-and-closing cover 5 in the direction, which intersects the opening-and-closing direction, and regulates a position of the opening-and-closing cover 5 in the direction intersecting the opening-and-closing direction so that the blocking portion 8 intersects the straight line, which is drawn along the opening-and-closing direction from the distal end position of the protrusion portion 7. The disengagement suppressing protrusion 10 is provided in the opening-and-closing cover 5 on an opposite side to the protrusion portion 7 in the direction, which intersects the opening-and-closing direction of the opening-and-closing cover 5. In the state where the opening-and-closing cover 5 is located in the closing position A, the disengagement suppressing protrusion 10 protrudes from the opening-and-closing cover 5 toward the cover holding frame 6 with a smaller amount of protrusion than the position regulating protrusion 9. When the opening-and-closing cover 5 moves along the opening-and-closing direction from the closing position A to a position where the position regulating protrusion 9 is located outside the opening-and-closing cover 5 and then moves toward the cover holding frame 6 along the intersection direction, the disengagement suppressing protrusion 10 is in contact with the cover holding frame 6. The disengagement suppressing protrusion 10 suppresses a behavior and attitude of the opening-and-closing cover 5 so that: when the opening-and-closing cover 5 takes such an attitude that the opening-and-closing cover 5 is swingably supported by a contact portion, serving as a fulcrum, between the disengagement suppressing protrusion 10 and the cover holding frame 6 and is arranged along the opening-and-closing operation direction, the distal end position of the protrusion portion 7 is located in a position where the distal end position can be released from the blocking portion 8; and when the opening-and-closing cover 5 takes such an attitude that the opening-and-closing cover 5 swings so that one side of the opening-and-closing cover 5 which is apart from the fulcrum approaches the cover holding frame 6, the distal end position of the protrusion portion 7 is located in a position where the blocking portion 8 blocks the distal end position of the protrusion portion 7.

The opening-and-closing behavior of the opening-and-closing cover 5 of the developer storage container 1 will be described. As shown in FIGS. 1B and 1C, it is assumed that the opening-and-closing cover 5 is located in the opening position D. When the opening-and-closing cover 5 is closed, the opening-and-closing cover 5 may be moved along the opening-and-closing direction toward the closing position A.

At this time, the opening-and-closing cover 5 is engaged with the position regulating protrusion 9 of the cover holding frame 6 in a state where the opening-and-closing cover 5 is located in the closing position A, moves in the intersection direction, which intersects the opening-and-closing direction, and is kept to have a positional relationship in which the protrusion portion 7 and the blocking portion 8 overlaps each other in the intersection direction. Therefore, even if it is intended to open the opening-and-closing cover 5 located in the closing position A straight along the opening-and-closing direction, the protrusion portion 7 and the blocking portion 8 are engaged with each other, and the opening-and-closing cover 5 is blocked.

Therefore, in this exemplary embodiment, in order to open the opening-and-closing cover 5 located in the closing position A, the opening-and-closing cover 5 may be moved straight along the opening-and-closing direction from the state where the opening-and-closing cover 5 is located in the closing position A, then be moved in the direction (a direction C in the drawing), which intersects the opening-and-closing direction of the opening-and-closing cover 5 as shown in FIG. 1C, in a stage where the position regulating protrusion 9 of the cover holding frame 6 is located outside the opening-and-closing cover 5, and be moved along the opening-and-closing direction again.

At this time, when the opening-and-closing cover 5 moves straight along the opening-and-closing direction from the closing position A, the opening-and-closing cover 5 reaches the certain intermediate position B, but the protrusion portion 7 comes into contact with the blocking portion 8 at the certain intermediate position B, whereby the opening-and-closing cover 5 is blocked. In this state, as shown in FIG. 1C, if it is intended to move the opening-and-closing cover 5 in the direction (the direction C in the drawing), which intersects the opening-and-closing direction of the opening-and-closing cover 5, the opening-and-closing cover 5 moves until the disengagement suppressing protrusion 10 of the opening-and-closing cover 5 comes into contact with the cover holding frame 6, and the opening-and-closing cover 5 moves to a position where the protrusion portion 7 and the blocking portion 8 can be disengaged. Therefore, if it is intended to move the opening-and-closing cover 5 toward the opening position D along the opening-and-closing direction, the opening-and-closing cover 5 reaches the opening position D to open the opening 3.

In this configuration, the developer storage container 1 may store therein an unused developer and/or may recover and store therein a used developer.

The container body 2 may be appropriately shaped so long as it can store the developer therein, instead of this exemplary embodiment in which the container body 2 extends long in an insertion/removal direction.

Furthermore, in order to avoid the developer stored in the container body 2 from forming local agglomerates due to change in environment or change with aging, the container body 2 may include a stirring member that can be driven by an external driving source. When the container body 2 includes the stirring member or the like, the container body 2 may be a cylindrical container having at least one open end and an end cover member that blocks the end opening.

The cover holding frame 6 may be separately or integrally provided in the vicinity of the opening 3 of the container body 2 in a position where it can hold the opening-and-closing cover 5 in an openable/closable manner between the opening position D and the closing position A of the opening 3. In this case, the cover holding frame 6 may be provided to surround the periphery of the opening 3 or may be provided only in a peripheral portion of the periphery of the opening 3 extending in the opening-and-closing direction of the opening-and-closing cover 5.

Also, a direction that is different from an insertion/removal direction of the developer storage container 1 may be selected as the opening-and-closing direction of the opening-and-closing cover 5. For example, when a developer insertion/removal direction is a direction in which the developer storage container 1 is linearly moved, a direction in which the developer storage container 1 is rotated may be selected as the opening-and-closing operation direction of the opening-and-closing cover 5. However, from the viewpoint of simplifying the opening-and-closing operation of the opening-and-closing cover 5, the opening-and-closing direction of the opening-and-closing cover 5 may coincide with a direction extending along the insertion/removal direction of the developer storage container 1.

A movement restriction position in which the protrusion portion 7 and the blocking portion 8 restrict the opening-and-closing cover 5 from further moving in the opening-and-closing direction is the certain intermediate position B that is closer to the closing position A than a position in which the opening-and-closing cover 5 starts to open the opening 3. With this configuration, even if it is attempted to move the opening-and-closing cover 5 in the opening direction with respect to the container body 2, the opening-and-closing cover 5 is restricted by the protrusion portion 7 and the blocking portion 8 from moving in the opening direction before the opening 3 starts to be open. Thus, the opening-and-closing cover 5 does not start to open the opening 3. For example, when the developer storage container 1 is dropped or when an external force is applied in the opening direction to the opening-and-closing cover 5 during transport, the opening-and-closing cover 5 does not immediately open the opening 3. As a result, the event that the developer leaks through the opening 3 is effectively prevented.

It is noted that the closing position A is not identical to the intermediate position B. If they are identical, to perform an opening/closing operation for the opening-and-closing cover 5, it would be necessary to perform two operations as the opening/closing operation, that is, first, the opening-and-closing cover 5 is moved in a direction different from the opening-and-closing direction and then moved in the opening-and-closing direction, which may complicate the opening/closing operation.

Also, the position regulating protrusion 9 may be provided in an arbitrary position of the cover holding frame 6 so long as the opening-and-closing cover 5 is moved in the direction, which intersects the opening-and-closing direction, so that the protrusion portion 7 and the blocking portion 8 implement the restriction of movement of the opening-and-closing cover 5.

Also, the disengagement suppressing protrusion 10 is provided on one side of the opening-and-closing cover 5 opposite to the protrusion portion 7 in the direction, which intersects the opening-and-closing direction of the opening-and-closing cover 5. With regard to a relationship between the disengagement suppressing protrusion 10 and the position regulating protrusion 9, the disengagement suppressing protrusion 10 is provided near the position regulating protrusion 9 and has a smaller protrusion amount than that of the position regulating protrusion 9. In the exemplary embodiment, by suppressing change in a behavior and attitude of the opening-and-closing cover 5, when the opening-and-closing cover 5 takes such an attitude that the opening-and-closing cover 5 is arranged along the opening-and-closing direction, the protrusion portion 7 and the blocking portion 8 can be disengaged. When the opening-and-closing cover 5 takes such a swing attitude that the opening-and-closing cover 5 is tilted with respect to the opening-and-closing direction, the blocking portion 8 may block the protrusion portion 7.

A dimensional relationship between the blocking portion 8 and the position regulating protrusion 9 will be described in more detail in a first exemplary embodiment.

Also, when a drop accident or an impact during transportation applies an external force onto the opening-and-closing cover 5 from a direction different from the opening-and-closing direction, the disengagement suppressing protrusion 10 applies a disengagement suppression moment onto the opening-and-closing cover 5 in a direction in which the opening-and-closing cover 5 is hardly disengaged from the cover holding frame 6. From this aspect, in a state where the opening-and-closing cover 5 is located in the closing position A, the disengagement suppressing protrusion 10 may be disposed with a gap from the position regulating protrusion 9.

Also, when the opening-and-closing cover 5 is made an elastic material, from the viewpoint of effectively utilizing the elastic action of the elastic material, a width between both side portions of the cover holding frame 6 excluding the position regulating protrusion 9 may be greater than a width from the protrusion portion 7 of the opening-and-closing cover 5 to the disengagement suppressing protrusion 10, where the direction perpendicular to the opening-and-closing direction of the opening-and-closing cover 5 is defined as the width direction.

Also, from the viewpoint that a position regulation of the opening-and-closing cover 5 by the position regulating protrusion 9 is better maintained, an auxiliary position regulating protrusion (not shown) may be further provided in the opening-and-closing cover 5. In the state where the opening-and-closing cover 5 is located in the closing position A, the auxiliary position regulating protrusion is in contact with the cover holding frame 6 with the protrusion amount equal to that of the position regulating protrusion 9 and regulates the position of the opening-and-closing cover 5 in the direction, which intersects the opening-and-closing direction.

Figure 2:
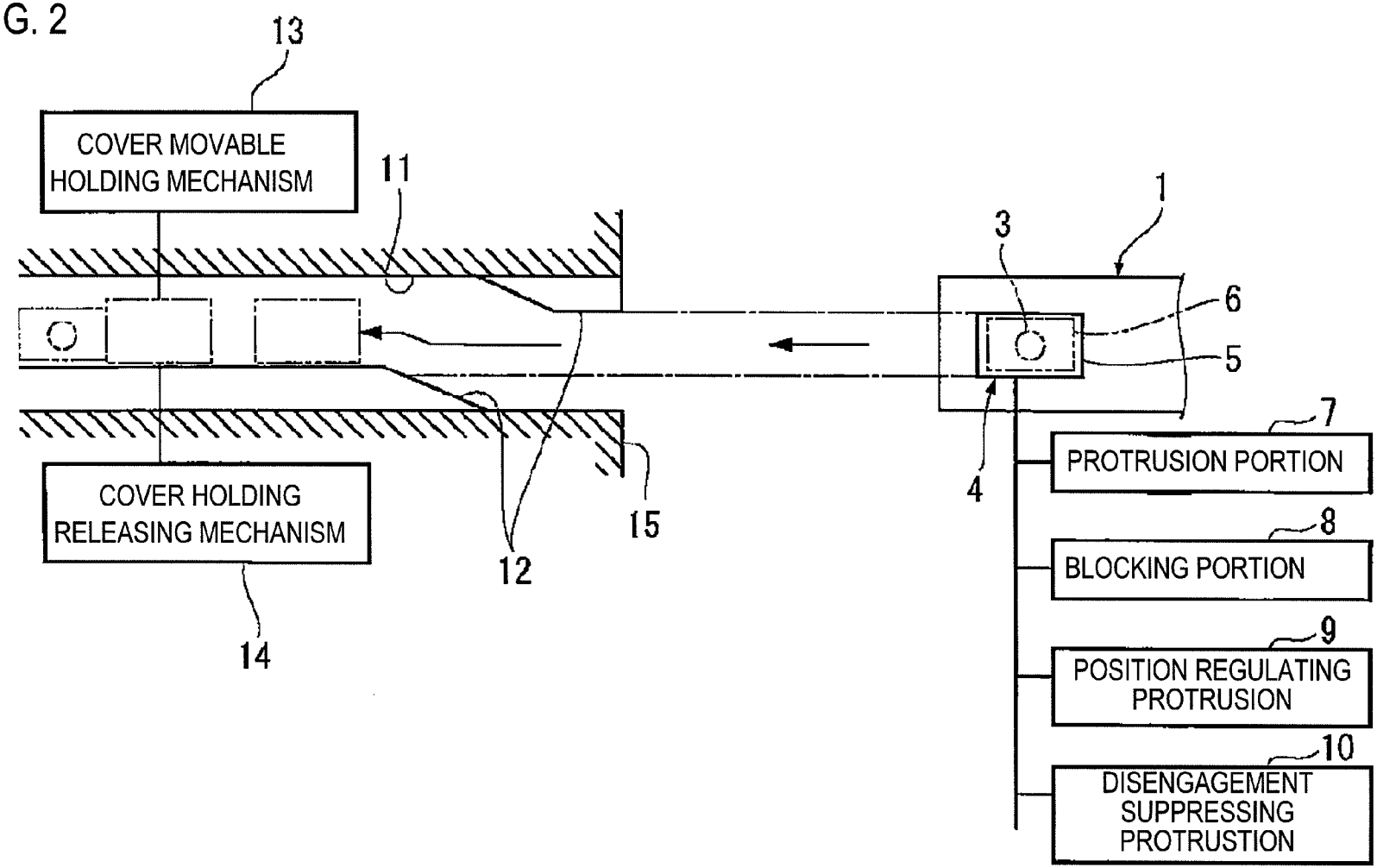
FIG. 2 is an explanatory diagram showing an outline of an image forming apparatus using the developer storage container according to the exemplary embodiment shown in FIG. 1.

FIG. 2 shows an example in which the image forming apparatus includes the developer storage container 1 according to the exemplary embodiments described above.

In this figure, the image forming apparatus includes a chassis 15 formed with a container receiving portion 11, and the developer storage container 1 configured to be removably inserted into the container receiving portion 11 of the chassis 15. The developer storage container 1 stores the developer therein.

Here, the developer storage container 1 has the container body 2 (see FIG. 1), the opening 3, the opening-and-closing cover 5, the cover holding frame 6, the protrusion portion 7, the blocking portion 8, the position regulating protrusion 9, and the disengagement suppressing protrusion 10. The container body 2 stores a developer therein. The opening 3 is provided in the portion of the container body 2. The opening-and-closing cover 5 is configured to block (close) the opening 3. The cover holding frame 6 holds the opening-and-closing cover 5 so that the opening-and-closing cover 5 is movable in the opening-and-closing direction between the opening position D in which the opening 3 is opened and the closing position A in which the opening 3 is closed. The protrusion portion 7 is provided in the opening-and-closing cover 5. The protrusion portion 7 protrudes towards the cover holding frame 6 in a direction intersecting the opening-and-closing direction in a state where the opening-and-closing cover 5 is located in the closing position A. The blocking portion 8 is provided in the cover holding frame 6. In a state where the opening-and-closing cover 5 is located in the closing position A, the blocking portion 8 is located in a position where the blocking portion 8 intersects a straight line which is drawn along the opening-and-closing direction from a distal end position, in a direction perpendicular to the opening-and-closing direction, of the protrusion portion 7, so that the blocking portion 8 is spaced apart from the protrusion portion 7. When the opening-and-closing cover 5 moves in the opening-and-closing direction from the closing position A toward the opening position D and reaches a certain intermediate position B in which it is not started to open the opening 3, the blocking portion 8 is in contact with the protrusion portion 7 and blocks the protrusion portion 7 of the opening-and-closing cover 5, which moves toward the opening position. The position regulating protrusion 9 protrudes from the cover holding frame 6 in a direction that intersects the opening-and-closing direction. When the opening-and-closing cover 5 moves toward the closing position A from a position where the protrusion portion 7 and the blocking portion 8 come into contact with each other, the position regulating protrusion 9 comes into contact with the opening-and-closing cover 5 to move the opening-and-closing cover 5 in the direction, which intersects the opening-and-closing direction, and regulates a position of the opening-and-closing cover 5 in the direction intersecting the opening-and-closing direction so that the blocking portion 8 intersects the straight line, which is drawn along the opening-and-closing direction from the distal end position of the protrusion portion 7. The disengagement suppressing protrusion 10 is provided in the opening-and-closing cover 5 on an opposite side to the protrusion portion 7 in the direction, which intersects the opening-and-closing direction of the opening-and-closing cover 5. In the state where the opening-and-closing cover 5 is located in the closing position A, the disengagement suppressing protrusion 10 protrudes from the opening-and-closing cover 5 toward the cover holding frame 6 with a smaller amount of protrusion than the position regulating protrusion 9. When the opening-and-closing cover 5 moves along the opening-and-closing direction from the closing position A to a position where the position regulating protrusion 9 is located outside the opening-and-closing cover 5 and then moves toward the cover holding frame 6 along the intersection direction, the disengagement suppressing protrusion 10 is in contact with the cover holding frame 6. The disengagement suppressing protrusion 10 suppresses a behavior and attitude of the opening-and-closing cover 5 so that: when the opening-and-closing cover 5 takes such an attitude that the opening-and-closing cover 5 is swingably supported by a contact portion, serving as a fulcrum, between the disengagement suppressing protrusion 10 and the cover holding frame 6 and is arranged along the opening-and-closing operation direction, the distal end position of the protrusion portion 7 is located in a position where the distal end position can be released from the blocking portion 8; and when the opening-and-closing cover 5 takes such an attitude that the opening-and-closing cover 5 swings so that one side of the opening-and-closing cover 5 which is apart from the fulcrum approaches the cover holding frame 6, the distal end position of the protrusion portion 7 is located in a position where the blocking portion 8 blocks the distal end position of the protrusion portion 7.

Meanwhile, the container receiving portion 11 of the chassis 15 of the image forming apparatus includes a cover guide rail 12, a cover holding mechanism 13 and a cover-holding releasing mechanism 14. The cover guide rail 12 guides the opening-and-closing cover 5 of the developer storage container 1. When the developer storage container 1 is being inserted, the cover holding mechanism 13 abuts against the opening-and-closing cover 5 to move the opening-and-closing cover 5 toward the opening position D and then holds the opening-and-closing cover 5. When the developer storage container 1 is being removed, the cover holding unit moves the opening-and-closing cover 5, which is located in the opening position D, toward the closing position A. When the developer storage container 1 is being removed and the opening-and-closing cover 5 reaches the closing position A, the cover-holding releasing mechanism 14 releases a state in which the cover holding mechanism 13 holds the opening-and-closing cover 5.

In this configuration, respective components of the developer storage container 1 are similar to those, which are described with reference to FIG. 1.

The container receiving portion 11 includes the cover guide rail 12, the cover holding mechanism 13, and the cover-holding releasing mechanism 14.

The cover guide rail 12 may be a continuous rail member or may be one that embodies a rail function that guides the opening-and-closing cover 5 using a wall member or a guide block member.

It is assumed that the developer storage container 1 includes the protrusion portion 7, the blocking portion 8, the position regulating protrusion 9, and the disengagement suppressing protrusion 10. The cover guide rail 12 may guide the opening-and-closing cover 5 which is moved by these elements 7 to 10.

For example, since the opening-and-closing cover 5 is movable in the intersecting direction, which intersects the opening-and-closing direction, a mechanism for releasing the restriction of the opening-and-closing cover 5 may be selected appropriately so long as the cover guide rail 12 can guide, in the movement restriction position (corresponding to the certain intermediate position B), the opening-and-closing cover 5 to move in the intersecting direction beyond the movement restriction position.

Also, any member may be used as the cover holding mechanism 13 so long as it can perform a function of moving the opening-and-closing cover 5 to the opening position D when the developer storage container 1 is being inserted, so as to hold the opening-and-closing cover 5 there and moving the opening-and-closing cover 5 from the opening position D to the closing position A when the developer storage container 1 is being removed.

Furthermore, any member may be used as the cover-holding releasing mechanism 14 so long as it can perform a function of releasing the state in which the cover holding mechanism 13 holds the opening-and-closing cover 5 when the developer storage container 1 is being removed.

According to one exemplary embodiment, the cover holding mechanism 13 includes an elastic holding part that extends in the opening-and-closing direction of the opening-and-closing cover 5 and is elastically deformable. When the developer storage container 1 is being inserted, the elastic holding part abuts against the opening-and-closing cover 5 to move the opening-and-closing cover 5 to the opening position D and the elastic holding part is elastically deformed outward at a time point when the opening-and-closing cover 5 reaches the opening position D, so as to be displaced from the opening-and-closing cover 5 and then hold the opening-and-closing cover 5 being located in the opening position D.

According to another exemplary embodiment in which the cover holding mechanism 13 is employed, the cover-holding releasing mechanism 14 includes a holding releasing protruding part that is elastically deformed in the direction for displacing the elastic holding part from the opening-and-closing cover 5 when the opening-and-closing cover 5 reaches the closing position A. The holding releasing protruding part releases the state in which the elastic holding part holds the opening-and-closing cover 5.

Hereinafter, exemplary embodiments of the invention will be described in detail with reference to the attached drawings.

Exemplary Embodiment 1

<Overall Configuration of Image Forming Apparatus>

Figure 3:
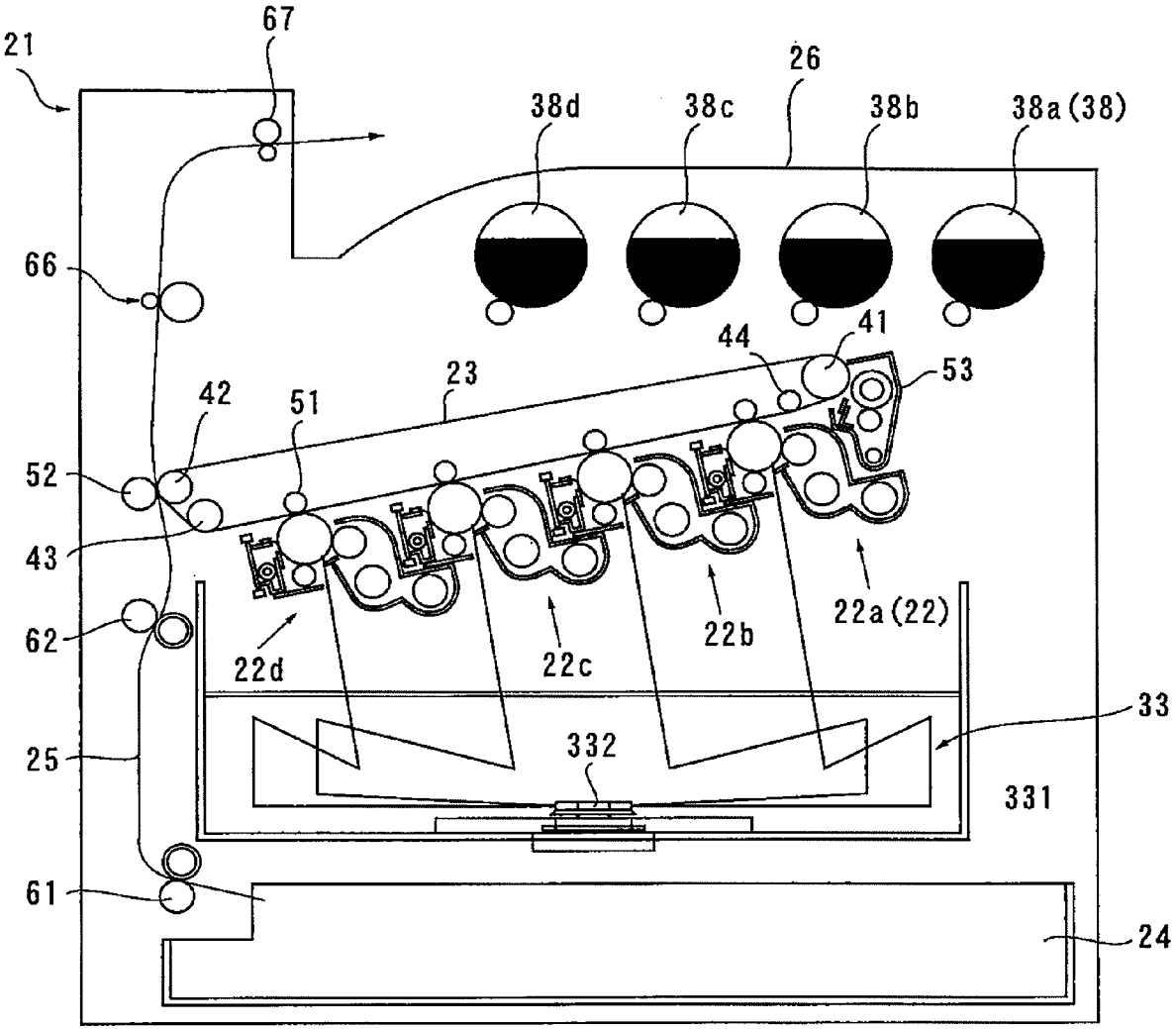
FIG. 3 is an explanatory diagram showing an overall configuration of the image forming apparatus according to a first exemplary embodiment of the invention.

FIG. 3 shows an overall configuration of an image forming apparatus according to a first exemplary embodiment of the invention.

In this figure, in a chassis 21 of the image forming apparatus (hereinafter, simply a chassis or an apparatus chassis), the image forming apparatus includes image forming portions 22 (specifically, 22*a* to 22*d*) for respective four colors (in this exemplary embodiment, black, yellow, magenta, and cyan) arranged in an obliquely upward direction; an intermediate transfer belt 23 that is arranged above the image forming portions 22 and rotate along the arrangement direction of the image forming portions 22; a recording-medium supply unit 24 that is arranged in a lower portion of the apparatus chassis 21 and stores and supplies recording media; and a recording-medium discharge tray 26 that is arranged in an upper portion of the apparatus chassis 21 and receives and stores discharged recording media on which images are formed. The recording medium supplied from the recording-medium supply unit 24 is discharged to the recording-medium discharge tray 26 through a recording-medium conveyance path 25 that extends in a vertical direction.

Figure 4:
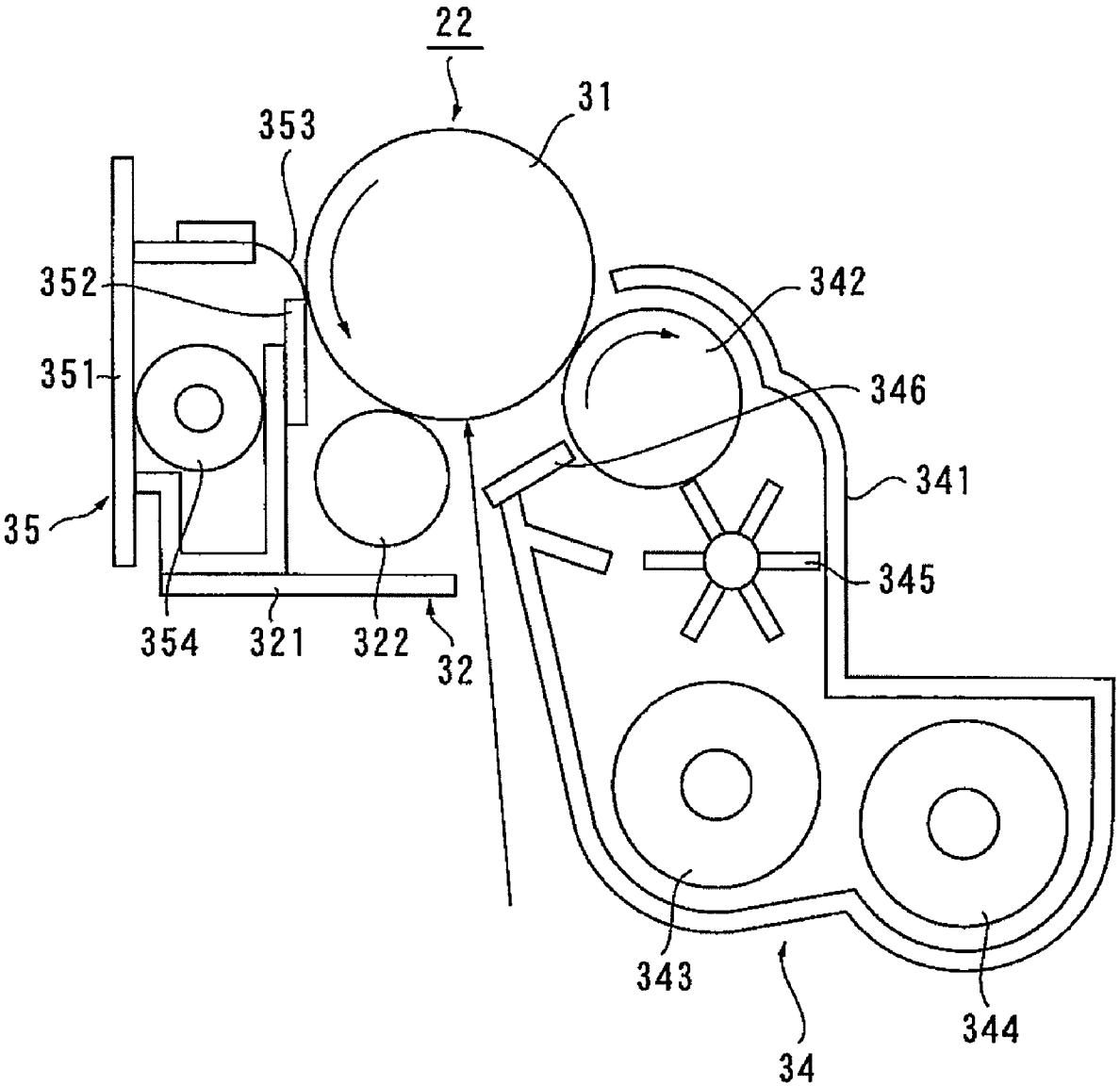
FIG. 4 is an explanatory diagram showing details of an image forming portion of the image forming apparatus shown in FIG. 3.

In this exemplary embodiment, as shown in FIGS. 3 and 4, the image forming portions 22 (22*a* to 22*d*) are configured to form, in order from the upstream side in the rotation direction of the intermediate transfer belt 23, toner images, for example, of black, yellow, magenta, and cyan (however, it is not necessary to arrange the colors in this order). Each image forming portion 22 includes a drum-shaped photosensitive member 31, a charging unit 32 that preliminarily charges the photosensitive member 31, an exposure unit 33 that forms an electrostatic latent image on the photosensitive member 31 charged by the charging unit 32, a developing unit 34 that develops the electrostatic latent image on the photosensitive member 31 into a visible image using a toner of the corresponding color, and a cleaning unit 35 that cleans a residual toner on the photosensitive member 31.

The exposure unit 33 is provided in common to the respective image forming portions 22 and is configured to deflect and scan light beams for the respective color components from a light source such as a semiconductor laser (not shown) within an exposure container 331 using a deflection mirror 332, thereby forming a light image in an exposure position on the corresponding photosensitive member 31 via a focusing lens (not shown) and mirrors (not shown).

The intermediate transfer belt 23 is wound around plural tension rollers 41 to 44 and is rotated, for example, by a tension roller 41 serving as a driving roller. On portions of the rear surface of the intermediate transfer belt 23, which correspond to the respective photosensitive members 31, primary transfer units 51 (for example, primary transfer rollers) are arranged. Voltage having a polarity opposite to the polarity charged to toner is applied to the primary transfer units 51. Thereby, the toner images formed on the photosensitive members 31 are electrostatically transferred onto the intermediate transfer belt 23.

Furthermore, a secondary transfer unit 52 (for example, a secondary transfer roller) is provided in a portion corresponding to the tension roller 42 on the downstream side of the image forming portion 22*d* disposed on the most-downstream side of the intermediate transfer belt 23. By the secondary transfer unit 52, the toner images primarily transferred onto the intermediate transfer belt 23 are secondarily transferred (collectively transferred) onto the recording medium.

Furthermore, an intermediate cleaning unit 53 for cleaning a residual toner on the intermediate transfer belt 23 is provided in a portion corresponding to the tension roller 41 on the downstream side of the second transfer portion of the intermediate transfer belt 23.

The intermediate transfer belt 23 is made by blending a rubber or a resin such as polyimide, polycarbonate, polyester, or polypropylene with an antistatic agent such as carbon black in appropriate proportions to a volume resistivity of $10^6$ to $10^{14}$ Ω·cm.

In this exemplary embodiment, the recording medium fed by a feeder 61 of the recording-medium supply unit 24 is conveyed to an appropriate number of conveyance rollers (not shown) in the recording-medium conveyance path 25 and passed through the secondary transfer portion of the secondary transfer unit 52 with the position being aligned at position alignment rollers 62. Then, non-fixed toner images on the recording medium are fixed by a fixing unit 66 by means of heat and pressure and discharged and stored to the recording-medium discharge tray 26 via a discharge roller 67.

In FIG. 3, reference numeral 38 (38*a* to 38*d*) denotes developer storage containers that replenish the developing units 34 of the respective image forming portions 22 (22*a* to 22*d*) with new developer (in this exemplary embodiment, toner).

<Image Forming Portion>

In particular, in this exemplary embodiment, as shown in FIG. 4, the photosensitive member 31 is configured as a process cartridge that is integrated with the charging unit 32 and the cleaning unit 35. The process cartridge is detachably attached to the apparatus chassis 21 and constitutes portions of the image forming portions 22 of each color component.

Here, the charging unit 32 includes a charging chamber 321 that is open to a portion opposite the photosensitive member 31, and a charging roller 322 is disposed in the charging chamber 321 so as to contact or approach the surface of the photosensitive member 31.

The cleaning unit 35 includes a cleaning chamber 351 that is open to a portion opposite the photosensitive member 31. At one end of the opening in the longitudinal direction of the cleaning chamber 351, a cleaning blade 352 formed of an elastic scraping plate is provided so as to contact the photosensitive member 31. At the other end of the opening in the longitudinal direction of the cleaning chamber 351, an elastic sealing member 353 is provided so as to contact the photosensitive member 31. Within the cleaning chamber 351, a leveling and conveying member 354 is provided for leveling and conveying residual materials such as toner scraped by the cleaning blade 352 in the longitudinal direction.

In addition, in this exemplary embodiment, the developing unit 34 is attached to the apparatus chassis 21 in a separate manner from the process cartridge and includes a developing chamber 341 that is open opposite the photosensitive member 31 and stores therein developer containing at least toner. In the vicinity of the opening of the developing chamber 341, a developer carrier 342 is provided capable of conveying developer toward a developing zone located at a portion opposite the photosensitive member 31. On the rear surface side of the developing chamber 341 rear the developer carrier 342, paired developer stirring and conveying members 343 and 344 are arranged capable of stirring and conveying developer in a circulating manner. Between the developer carrier 342 and the developer stirring and conveying member 343 disposed close to the developer carrier 342, a developer supply member 345 is provided capable of supplying the stirred and conveyed developer toward the developer carrier 342. The developer supplied to the developer carrier 342 is supplied to the developing zone with the layer thickness being regulated by a layer-thickness regulating member 346.

<Developer Replenishing System>

Figure 5:
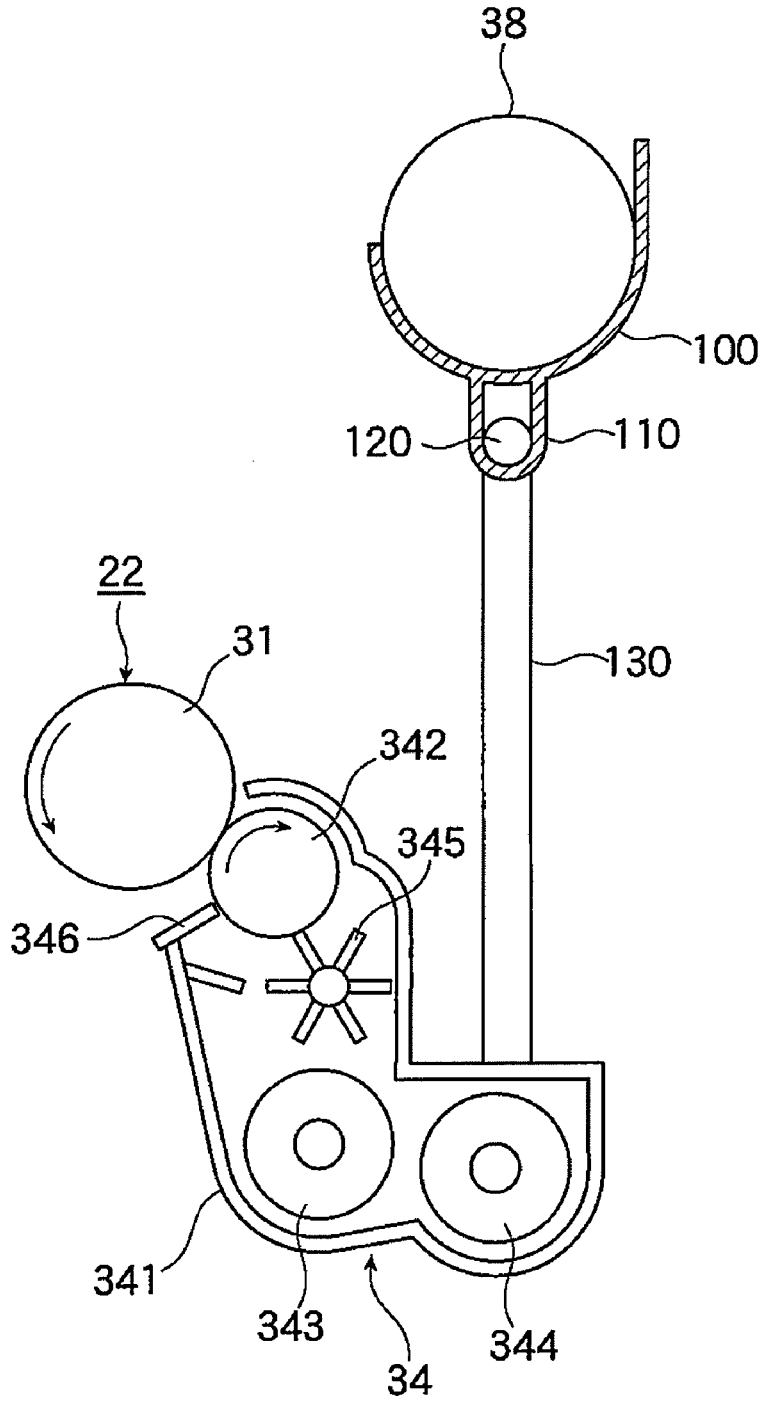
FIG. 5 is an explanatory diagram showing an example of a container receiving portion for the developer storage container used in the image forming apparatus shown in FIG. 3.

FIG. 5 shows an example of a developer replenishing system used in this exemplary embodiment.

In the drawing, the developer replenishing system includes a container receiving portion 100 which is formed in a portion of the apparatus chassis 21 and to which the developer storage container 38 is removably attached. In the lower portion of the container receiving portion 100, a reserve tank 110 is provided in which replenishing developer is temporarily stored. In the container receiving portion 100, discharge ports (not shown) are formed so that developer stored in the developer storage container 38 can be discharged when the developer storage container is attached thereto. In the reserve tank 110, a constant-amount supplying member 120 is provided so that a constant amount of developer stored in the tank can be supplied. Based on concentration information such as low developer concentration, the developing chamber 341 of the developing unit 34 is replenished with a predetermined amount of developer via a duct 130 connected to a portion of the reserve tank 110.

<Developer Storage Container>

Figure 6:
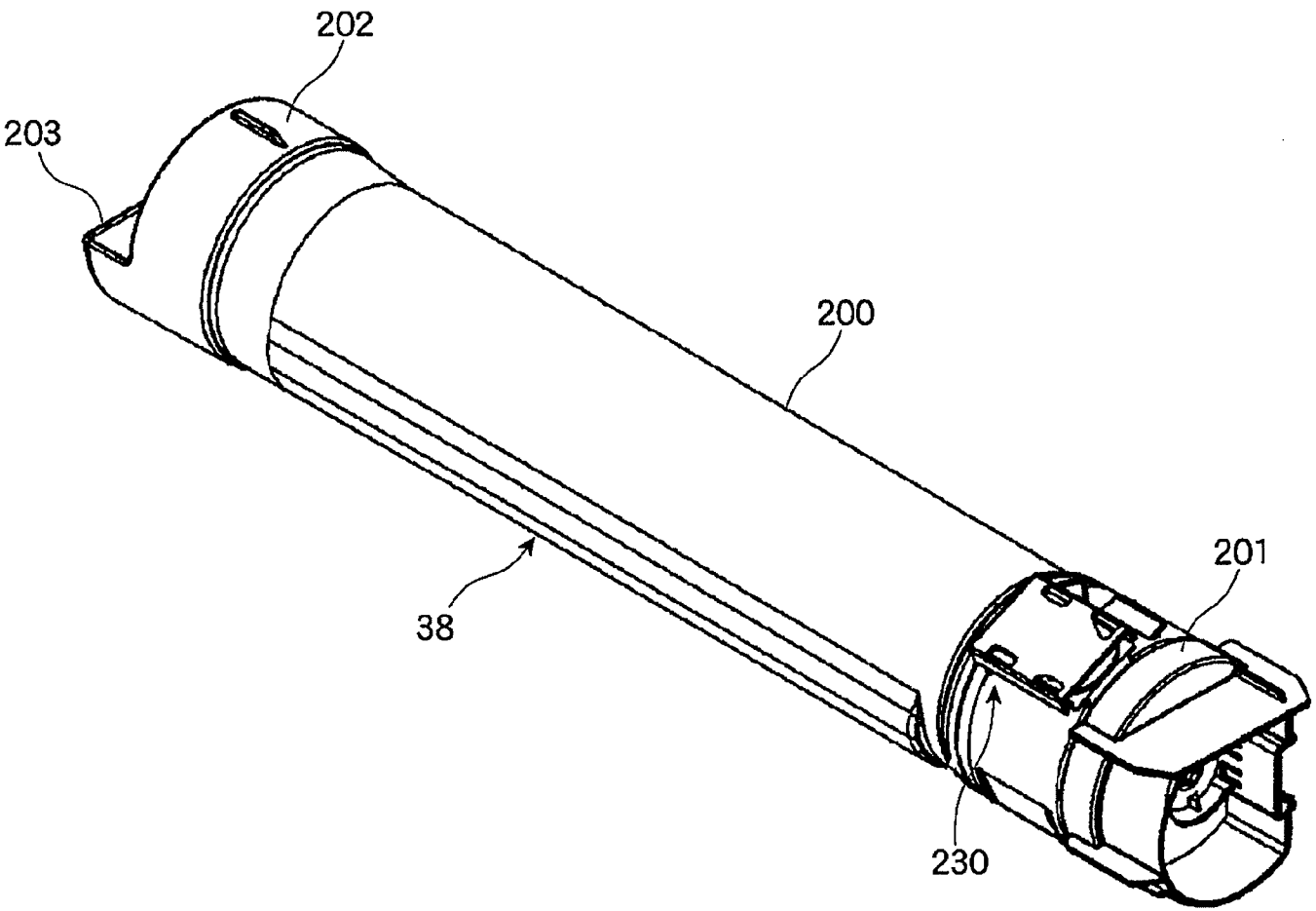
FIG. 6 is a perspective diagram showing an overall configuration of the developer storage container used in the first exemplary embodiment.
Figure 7:
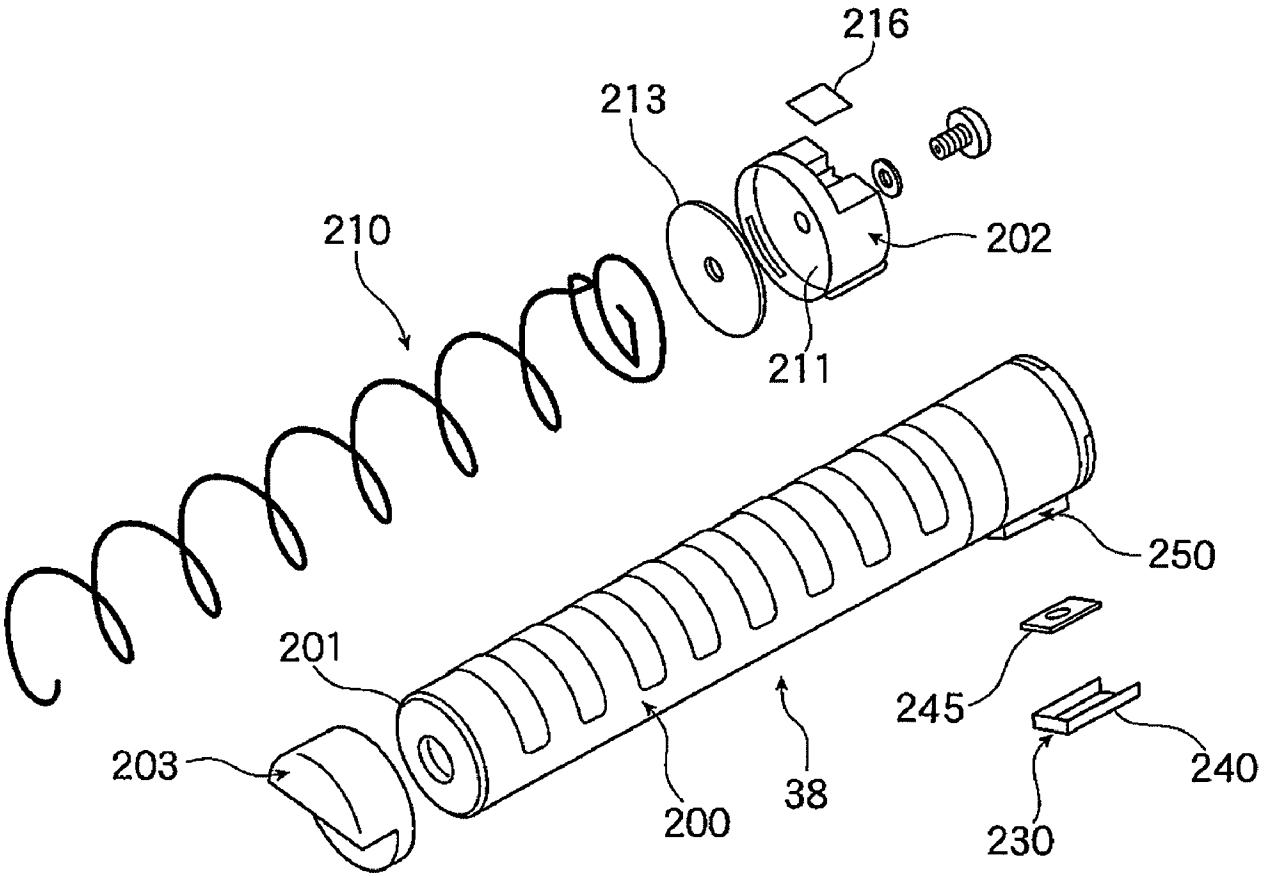
FIG. 7 is an exploded perspective view of the developer storage container shown in FIG. 6.

In this exemplary embodiment, as shown in FIGS. 6 and 7, the developer storage container 38 includes an elongated cylindrical container body 200 having open ends, made of synthetic resin such as ABS or PET, and formed by a stretch blow molding process. Within the container body 200, an agitator 210 as a stirring member capable of stirring stored developer is provided. At both ends of the cylindrical container body 200, end flanges 201 and 202 are attached.

Figure 8A:
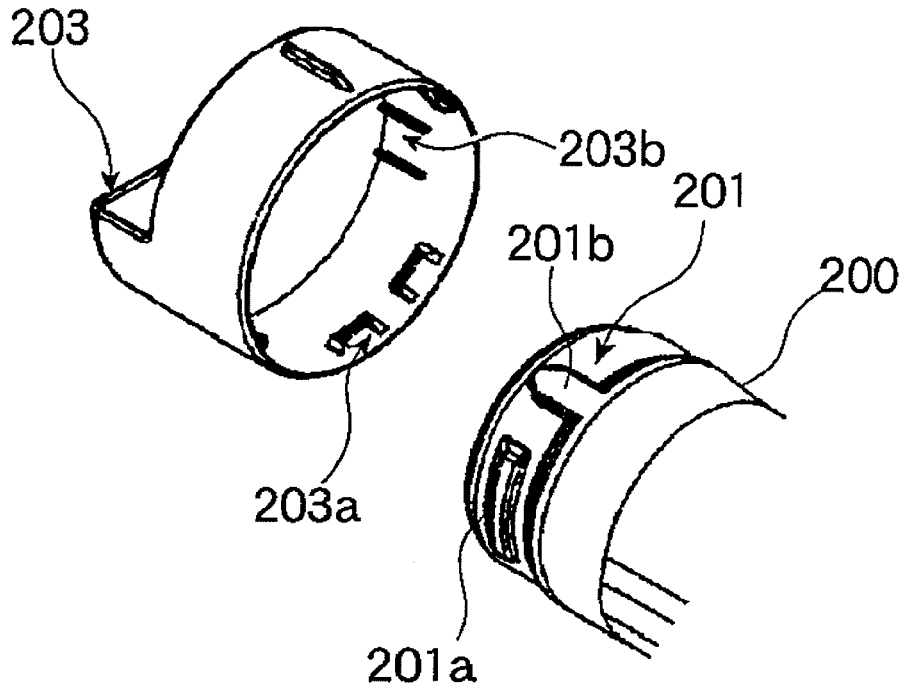
FIGS. 8A and 8B are explanatory diagrams showing details of the developer storage container in the vicinity of both ends thereof.

Here, a grasping handle 203 is provided at one end flange 201. As shown in FIG. 8A, the handle 203 is fitted to the one end flange 201. Further, drop-out preventing, elastic holding parts 203*a* are hooked on a step portion 201*a* of the end flange 201. A positioning end portion 201*b* of the end flange 201 is inserted into a rotation preventing concave portion 203*b*.

Figure 9A:
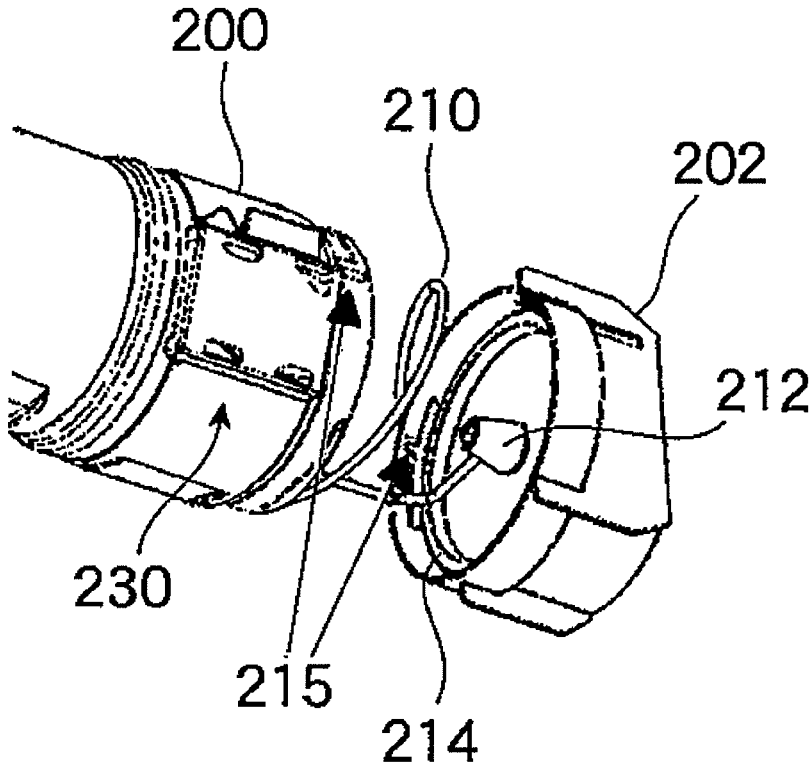
FIG. 9A is an explanatory diagram showing a state where one end flange of the developer storage container is detached.
Figure 9B:
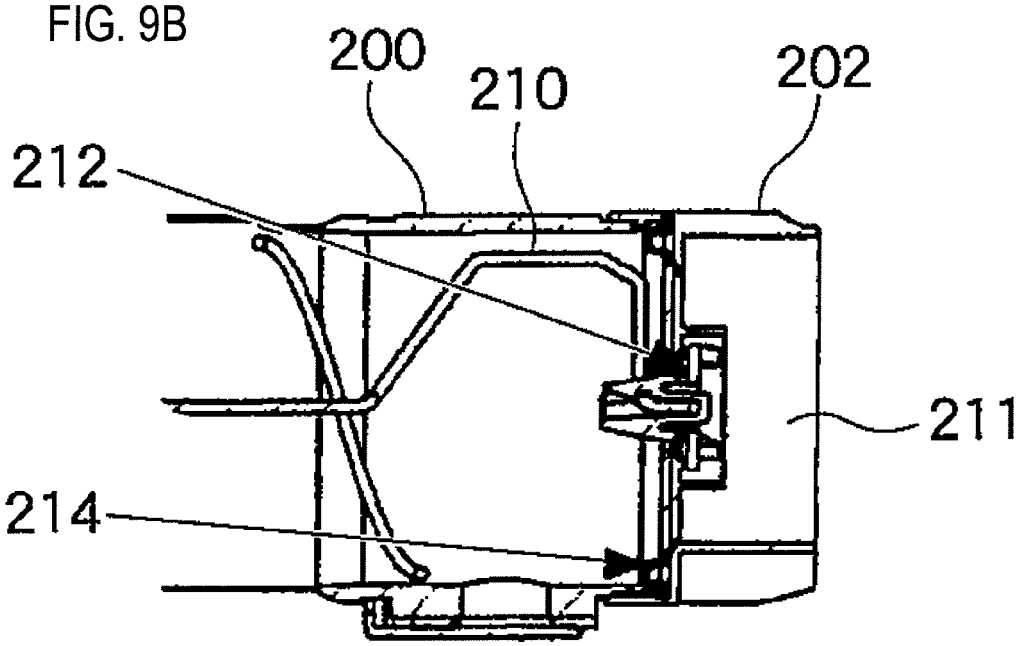
FIG. 9B is an explanatory diagram showing an example of an attachment structure for attaching an agitator to an end flange.

In the other end flange 202, as shown in FIG. 7 and FIGS. 9A and 9B, a rotor 211 is provided which is connected to a driving shaft from an external driving source (not shown). At the center of the inner surface of the rotor 211, a hook portion 212 is provided on which a shaft portion of the agitator 210 is hooked and supported. A sealing member 213 is provided between the end flange 202 and the container body 200. A ring-shaped sealing member 214 is provided between the rotor 211 and the end flange 202, thereby sealing a space therebetween. In addition, reference numeral 215 denotes rotation stoppers formed as a protrusion and a groove, provided, respectively, in the other end flange 202 and the container body 200 in a fitting manner.

Figure 8B:
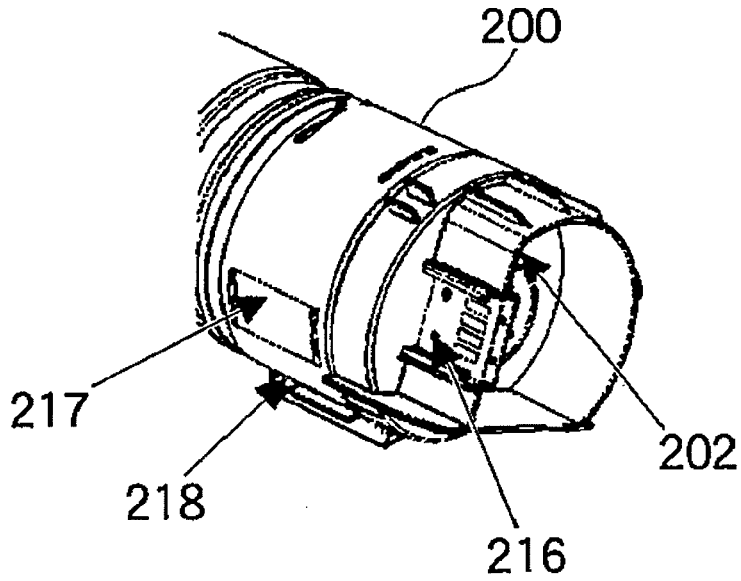

In this exemplary embodiment, as shown in FIG. 8B, a CRUM (Customer Replaceable Unit Memory) 216 as a usage management memory is attached to the other end flange 202. When the developer storage container 38 is attached to the container receiving portion 100, the CRUM 216 is connected so as to be able to communicate with a control unit (not shown) and usage history of the developer storage container 38 is recorded on the CRUM 216. Further, reference numeral 217 denotes a holding surface of the container body 200 during assembly or during developer filling operations, and reference numeral 218 denotes a rotation stopper when attaching the end flange 202.

<Shutter>

In this exemplary embodiment, a discharge opening 220 is formed in the vicinity of one end, in the longitudinal direction, of the peripheral wall of the cylindrical container body 200. A shutter 230, serving as an opening-and-closing mechanism, for opening/closing the opening 220 is provided for the discharge opening 220.

Figure 10:
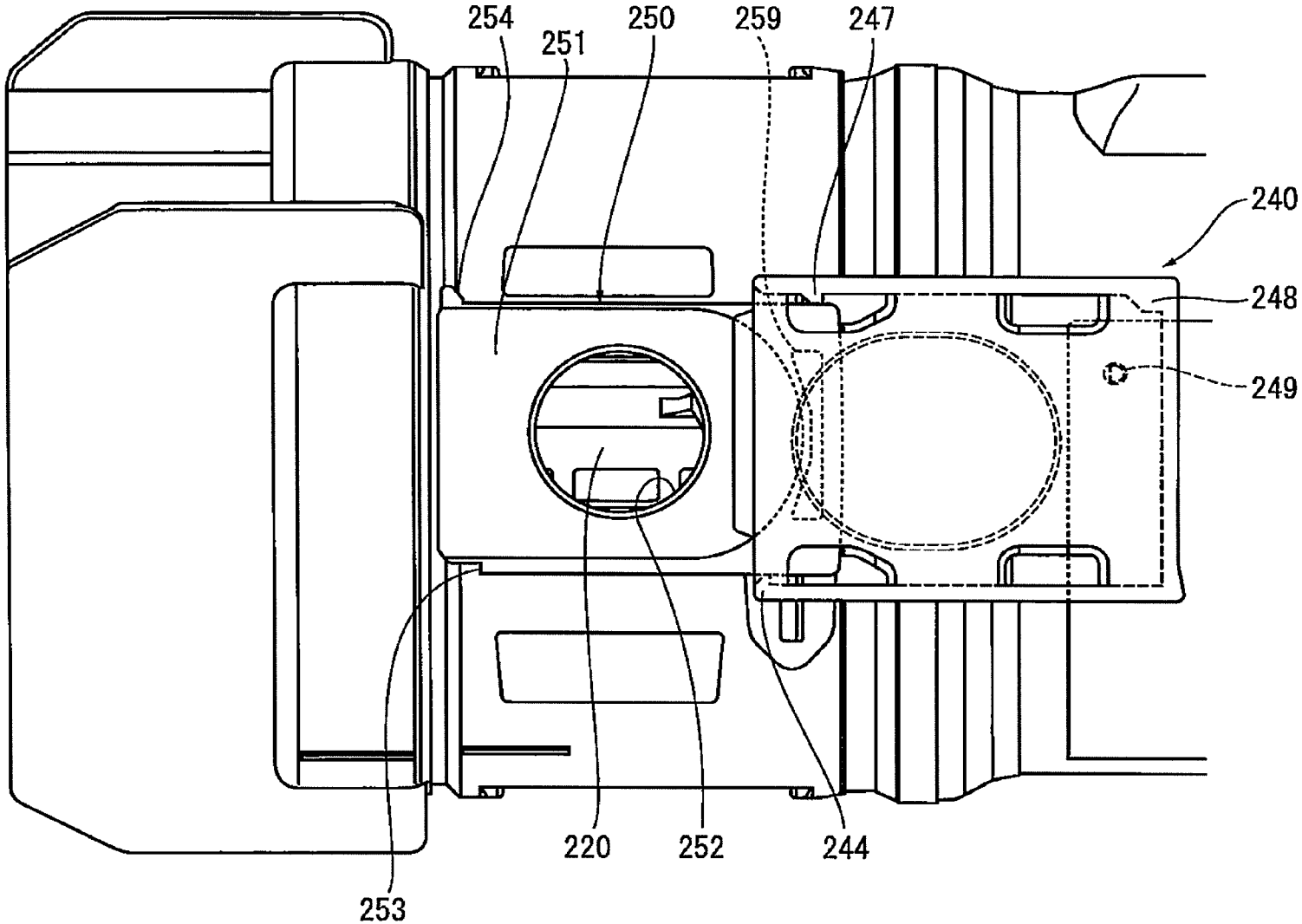
FIG. 10 is an explanatory diagram showing details of a shutter (the opening-and-closing cover and the cover holding frame) which is used in the first exemplary embodiment and serves as an opening-and-closing mechanism.
Figure 11B:
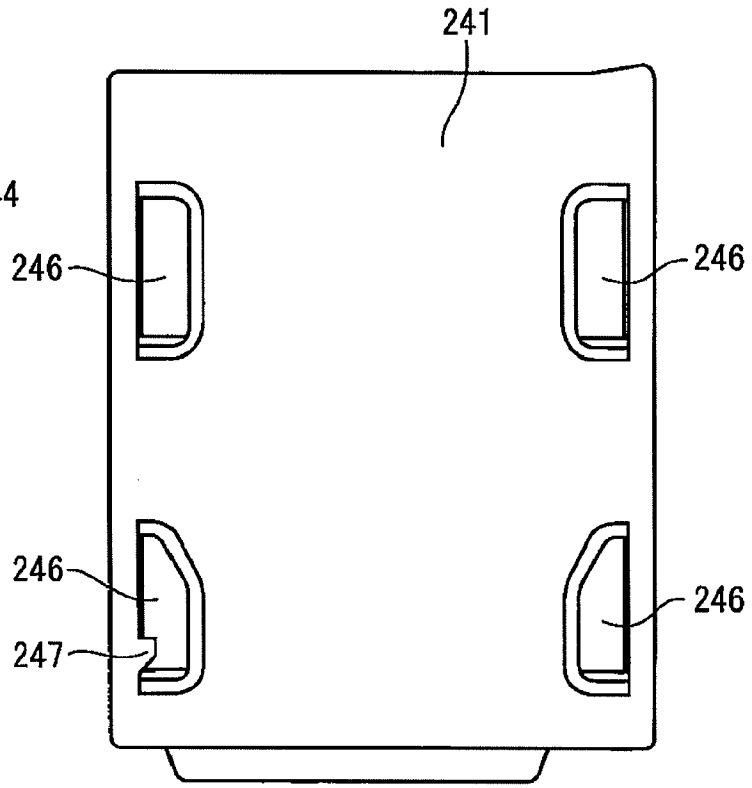
FIG. 11B is a view as seen from a direction B in FIG. 11A.

In this exemplary embodiment, as shown in FIGS. 10 and 11, the shutter 230 includes an opening-and-closing cover 240 configured to block the discharge opening 220, and a cover holding frame 250 that holds the opening-and-closing cover 240 so that the opening-and-closing cover 240 is movable in an opening-and-closing direction.

<Opening-and-Closing Cover>

Here, the opening-and-closing cover 240 includes a cover body 241 having a substantially flat-plate-shape and having a size of at least an area greater than that of the discharge opening 220. Side wall portions 242 are formed corresponding to three sides except in one direction which is the opening-and-closing direction of the cover body 241. An appropriate number of holding arms 243 which protrude inward and embrace and hold the cover holding frame 250 are provided in the side wall portions 242, which are located on both sides in the width direction intersecting the opening-and-closing direction (in the exemplary embodiment, two arms which are spaced apart from each other in the opening-and-closing direction are provided for each side wall portion 242). A hook claw 244 (an example of a protrusion portion) is formed at an open end of the side wall portion 242, which is located on one side of the cover body 241 in the width direction. A disengagement suppressing protrusion 247 that protrudes toward the cover holding frame 250 is formed near the open end of the side wall portion 242 and inside the side wall portion 242, which is located on the other side of the cover body 241 in the width direction. An auxiliary position regulating protrusion 248 that protrudes toward the cover holding frame 250 is formed at an inner corner which is apart from the open end of the side wall portion 242 formed with the disengagement suppressing protrusion 247.

Figure 12:
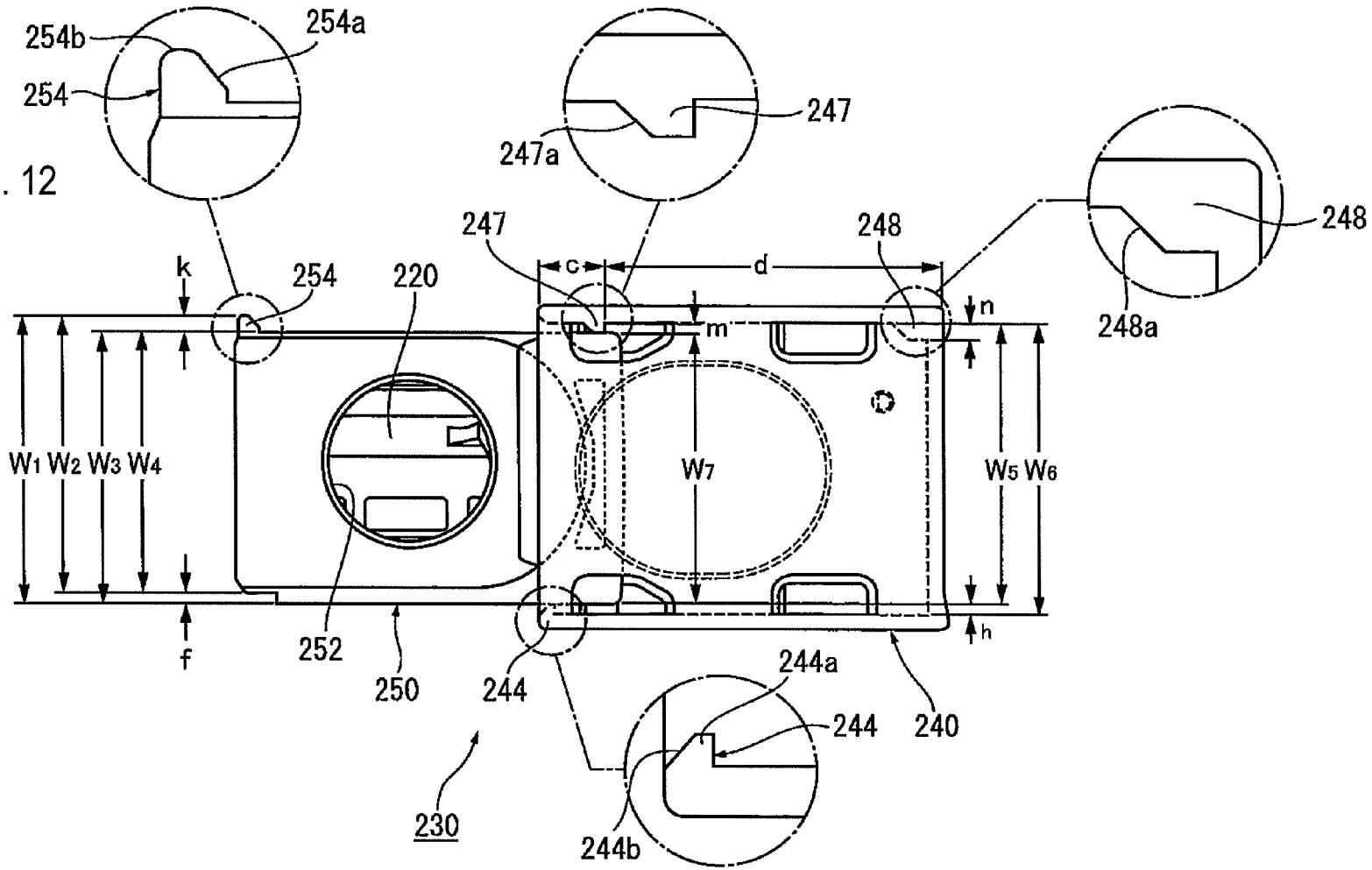
FIG. 12 is an explanatory diagram showing details of a dimension relation for the shutter (an opening-and-closing cover and a cover holding frame) used in the first exemplary embodiment to perform an opening/closing operation.

In particular, in the exemplary embodiment, as shown in FIG. 12, the hook claw 244 has a taper portion 244*b* which is tapered toward a catching end of a hook-like claw portion 244*a*, and has a structure that the hook claw 244 is apt to elastically deform at the catching end of the hook-like claw 244*a*.

Also, as shown in FIG. 12, the disengagement suppressing protrusion 247 is formed in a trapezoidal cross-sectional shape having a guide taper portion 247*a* which inclines in a protruding direction toward the cover holding frame 250 on the open-end side which is other than the side wall portions 242 of the three sides of the opening-and-closing cover 240.

Moreover, as shown in FIG. 12, the auxiliary position regulating protrusion 248 is also formed in a trapezoidal cross-sectional shape having a guide taper portion 248*a* which inclines in the protruding direction toward the cover holding frame 250 on the open-end side other which is than the side wall portions 242 of the three sides of the opening-and-closing cover 240.

Also, in the exemplary embodiment, for example, an elastic seal material 245 (see FIG. 11A) which comes into elastic contact with the surface of the cover holding frame 250 is stuck on the side surface of the cover holding frame 250 of the cover body 241. Also, hole portions 246 are provided in portions of the cover body 241 corresponding to the holding arms 243. This opening-and-closing cover 240 holds at three points both side edges of the cover holding frame 250 by two holding arms 243 and the cover body 241 located between the holding arms 243 so as to move along both the side edges of the cover holding frame 250 stably.

Figure 11A:
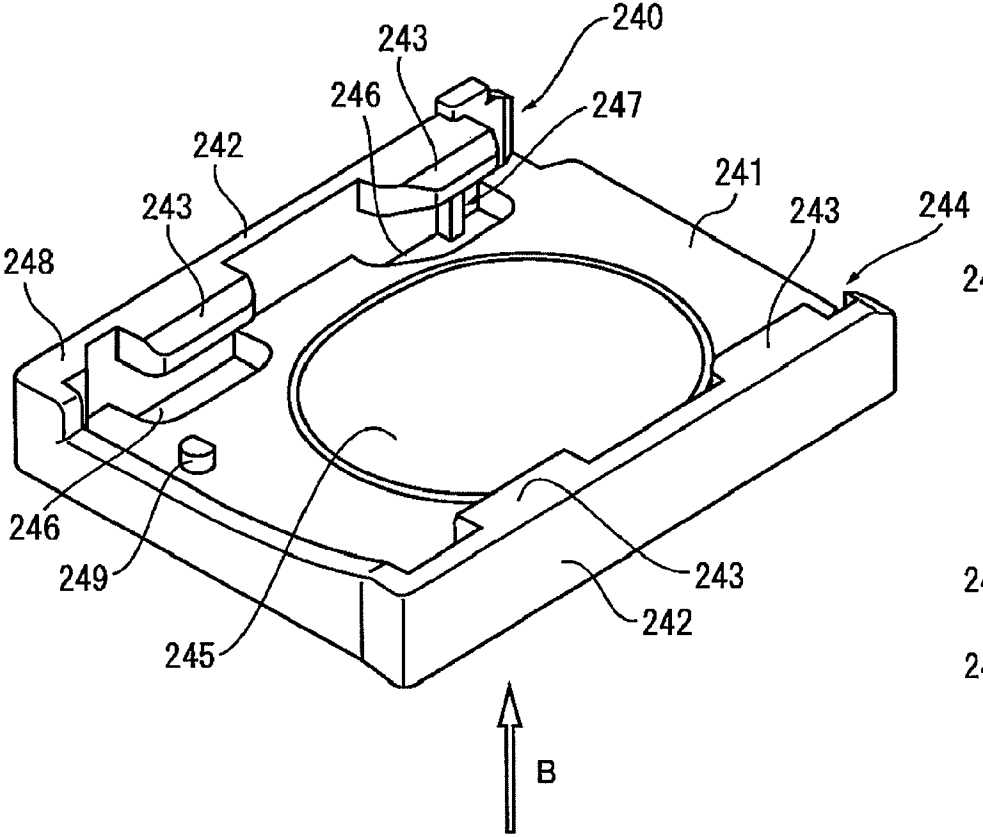
FIG. 11A is a perspective view when the opening-and-closing cover of the shutter used in the first exemplary embodiment 1 is viewed from the rear thereof.

Also, in FIG. 11A, reference numeral 249 is a stopper protrusion protruding from a portion of a rear surface of the cover body 241 of the opening-and-closing cover 240. For example, when the cover body 241 of the opening-and-closing cover 240 is crushed and deformed due to an external force, the stopper protrusion 249 fits into a stopper groove 259 (see FIGS. 10 and 19) formed in the cover holding frame 250, so as to prevent the opening-and-closing cover 240 is unnecessarily opened.

<Cover Holding Frame>

In this exemplary embodiment, as shown in FIG. 10, the cover holding frame 250 includes a frame body 251 having a substantially rectangular flat board shape. A through hole 252 is formed in a portion of the frame body 251, which corresponds to the discharge opening 220. A notch-shaped blocking portion 253 is formed in one corner portion of an edge of the frame body 251 in the closing direction of the opening-and-closing cover 240. A position regulating protrusion 254 is formed in the other corner portion of the edge of the frame body 251 in a direction in which the opening-and-closing cover 240 is closed, so as to protrude in the width direction perpendicular to the opening-and-closing direction.

Also, in this exemplary embodiment, a dimension between the both edges, in the width direction, of the cover holding frame 250 is set so as to be slightly smaller than that between the side walls 242 on the both sides of the opening-and-closing cover 240 in the width direction.

Furthermore, in this exemplary embodiment, as shown in FIGS. 10 to 12, a dimension k of a protrusion of the position regulating protrusion 254 from a reference position of the both edges, in the width direction, of the cover holding frame 250 is larger than that, in the width direction, of the blocking portion 253. When the side wall 242, in the width direction, of the opening-and-closing cover 240 abuts against the reference position of the side edge, in the width direction, of the cover holding frame 250, the opening-and-closing cover 240 has moved in the width direction by an amount corresponding to the dimension k of the protrusion of the position regulating protrusion 254. As a result, the hook claw 244 of the opening-and-closing cover 240 is not in contact with the blocking portion 253 and they are maintained in a positional relation that the restriction state is released.

In particular, in the exemplary embodiment, as shown in FIG. 12, the position regulating protrusion 254 is disposed closer to the tip side of the cover holding frame 250 than a catching surface of the blocking portion 253 in which the blocking portion 253 catches the hook claw 244, in the opening-and-closing direction of the opening-and-closing cover 240. The position regulating protrusion 254 has a guide taper portion 254*a* so that the opening-and-closing cover 240 is guided in a direction intersecting the opening-and-do sing direction when the tip of one side wall portion 242 of the opening-and-closing cover 240 abuts against the position regulating protrusion 254. From the viewpoint of reducing the frictional resistance against the inner surface of the side wall portion 242 of the opening-and-closing cover 240, the position regulating protrusion 254 has a curve portion 254*b* from the guide taper portion 254*a* to an apex thereof.

FIG. 12 shows the dimensional relation in order for the shutter 230 (the opening-and-closing cover 240 and the cover holding frame 250) to perform the opening/closing operation.

In this figure, w1 to w7, c, d, f, h, k, m and n are defined as follows:

w1 denotes the maximum width of the cover holding frame 250 up to a distal end of the position regulating protrusion 254.

w2 denotes a width of the cover holding frame 250 from the distal end of the position regulating protrusion 254 to the blocking portion 253.

w3 denotes a width of the cover holding frame 250 between the both sides excluding the position regulating protrusion 254.

w4 denotes a width of the cover holding frame 250 from one side thereof to the blocking portion 253 excluding the position regulating protrusion 254.

w5 denotes a width of the opening-and-closing cover 240 from an inner surface of one side wall thereof in the width direction to the hook claw 244.

w6 denotes the maximum width of the opening-and-closing cover 240 between the both side walls 242 in the width direction excluding the hook claw 244.

w7 denotes a width from the hook claw 244 of the opening-and-closing cover 240 to the disengagement suppressing protrusion 247.

c denotes a length from a contact portion between the disengagement suppressing protrusion 247 and the cover holding frame 250 to the end of the opening-and-closing cover 240 in the closing direction.

d denotes a length from a contact portion between the disengagement suppressing protrusion 247 and the cover holding frame 250 to the end of the opening-and-closing cover in the opening direction.

f denotes a blocking length of the blocking portion 253.

h denotes a hooking length of the hook claw 244.

k denotes a protrusion dimension of the position regulating protrusion 254.

m denotes a protrusion dimension of the disengagement suppressing protrusion 254.

n denotes a protrusion dimension of the auxiliary position regulating protrusion 248.

With reference to this figure, conditions required for the case where the opening-and-closing cover 240 is fitted to the cover holding frame 250 will be considered. If w2>w5 and w3>w5, the opening-and-closing cover 240 cannot be fitted to the cover holding frame 250. Therefore, it is necessary to satisfy the relationships of w5−w2>0 and w5−w3>0.

Next, if w1<w5, even when the opening-and-closing cover 240 is moved along the distal end position of the position regulating protrusion 254, the hook claw 244 does not overlap the blocking portion 253 in the opening-and-closing direction. Therefore, there is a concern that the blocking portion 253 does not function as the movement restricting unit. Accordingly, it is necessary to satisfy the relationship of w1−w5>0.

Then, the blocking length f (=w1−w2) of the blocking portion 253 will be considered. It is necessary that f is larger than the gap of w5−w2; that is, it is necessary to satisfy the relationship of f−(w5−w2)>0, that is, f>w5−w2.

Similarly, considering the protrusion dimension k (=w1−w3) of the position regulating protrusion 254, it is necessary that k is larger than the gap of w5−w3, that is, it is necessary to satisfy the relationship of k−(w5−w3)>0, that is, k>w5−w3.

Furthermore, if the hooking length h (=w6−w5) of the hook claw 244 is small, w1>w6 may be true and it becomes unable to perform fitting. Therefore, in order to enable the fitting, it is necessary to satisfy the relationship of w6−w1>0.

In this case, it is necessary that h is larger than w6−w1, that is, it is necessary to satisfy the relationship of h−(w6−w1)>0, that is, h>w6−w1.

Also, in the exemplary embodiment, the inventors gives attention to the fact that the opening-and-closing cover 240 is made of an elastic material, and as shown in FIG. 12, w3>w7 is satisfied.

At this time, with regard to the dimensional relationship between w3 and w7, w3 may be equal to w7. However, if w3>w7 is satisfied as described above, when the opening-and-closing cover 240 is being moved along the opening-and-closing direction, the opening-and-closing cover 240 is stably held by an elastic force with respect to the cover holding frame 250, and the hook claw 244 is reliably hooked to the blocking portion 253. In this respect, w3>w7 may be adopted.

Also, the protrusion dimension m of the disengagement suppressing protrusion 247 and the protrusion dimension n of the auxiliary position regulating protrusion 248 are set so as to satisfy m<k and n=k with respect to the protrusion dimension k of the position regulating protrusion 254.

Figure 17B:
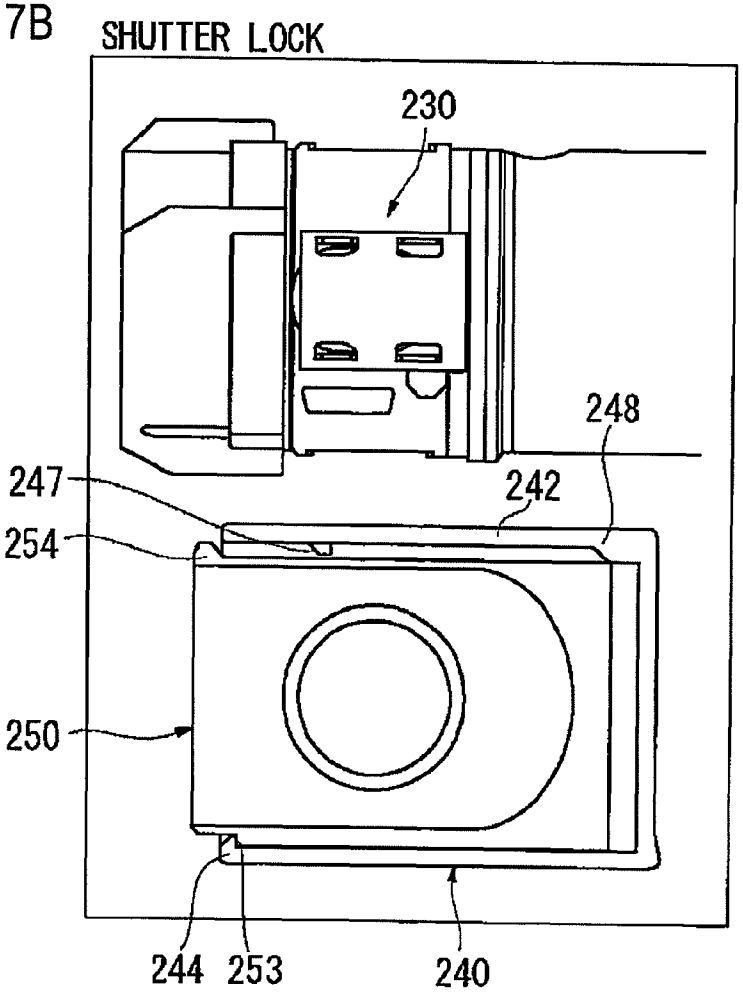
FIG. 17B is an explanatory diagram showing an operation flow of the shutter in which the opening-and-closing cover is in the lock state.
Figure 17A:
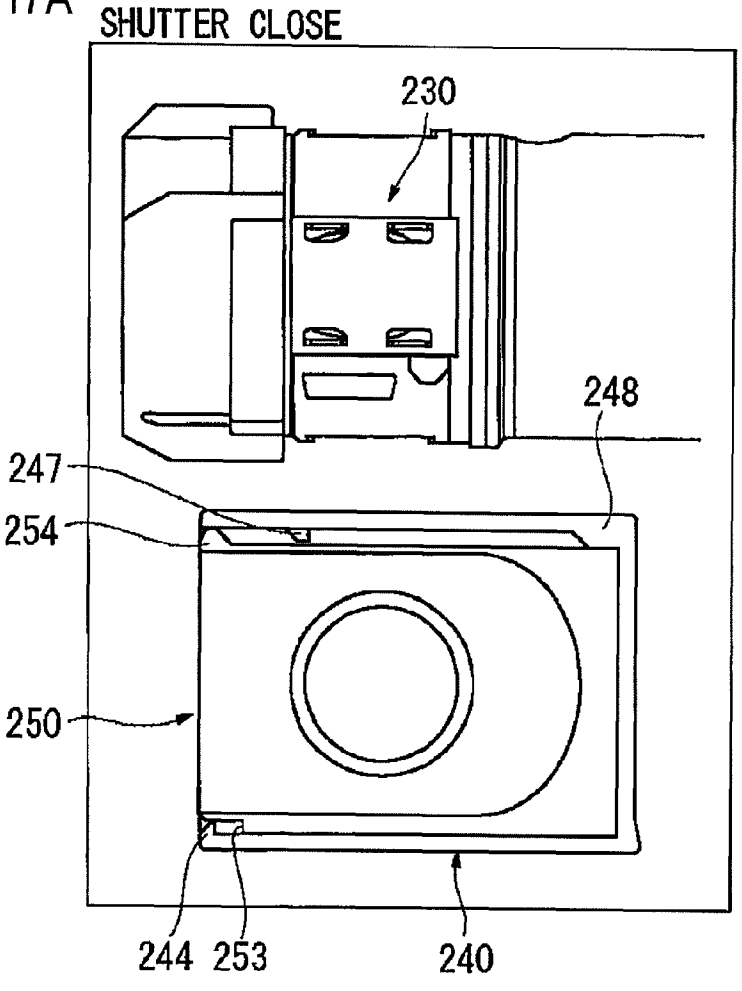
FIG. 17A is an explanatory diagram showing an operation flow of the shutter in which the opening-and-closing cover is located in the closing position.

Furthermore, with regard to the layout of the disengagement suppressing protrusion 247, the relationship of c<d is satisfied. Also, as shown in FIG. 17A, a gap may be secured between the disengagement suppressing protrusion 247 and the position regulating protrusion 254 in a state where the opening-and-closing cover 240 is located in the closing position.

Details of operation of these will be described later with reference to FIGS. 19 and 20.

<Shutter Operation Flow>

In this exemplary embodiment, the shutter 230 is operated in accordance with an operation flow as shown in FIGS. 13 to 16.

Figure 13B:
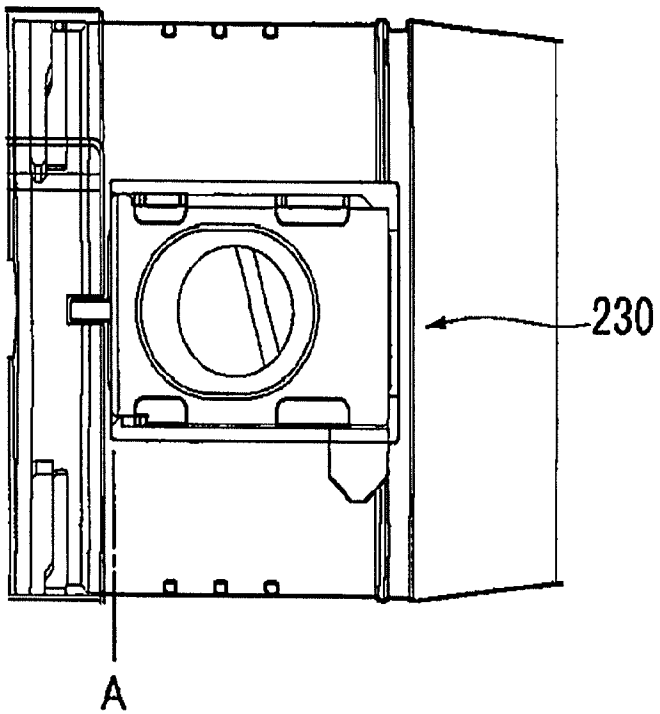
FIG. 13B is an explanatory top view of FIG. 13A.
Figure 13A:
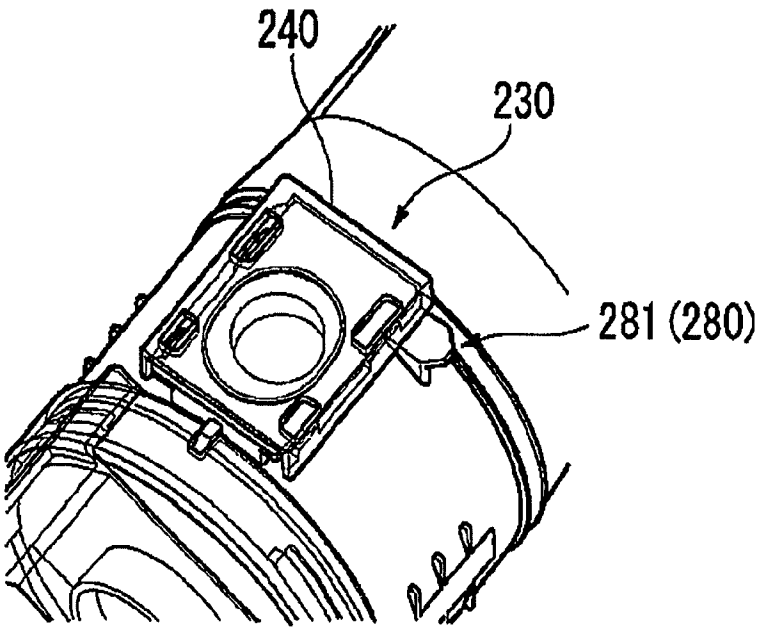
FIG. 13A is a perspective diagram showing a state where the opening-and-closing cover of the shutter is located in a closing position.

(1) Shutter Close (FIGS. 13A and 13B)

FIGS. 13A and 13B show the state in which the opening-and-closing cover 240 is located in the closing position A where the discharge opening 220 is completely closed.

At that moment, as shown in FIG. 17A, the side wall 242, in the opening-and-closing direction, of the opening-and-closing cover 240 abuts against one end of the cover holding frame 250 in the opening-and-closing direction. The side wall 242, in the width direction, of the opening-and-closing cover 240 is located in a position where the side wall 242 abuts against the distal end of the position regulating protrusion 254 of the cover holding frame 250.

In particular, in the exemplary embodiment, since the auxiliary position regulating protrusion 248 of the opening-and-closing cover 240 comes into contact with the cover holding frame 250, the attitude of the opening-and-closing cover 240 located in the closing position A is held straight along the opening-and-closing direction.

Figure 14B:
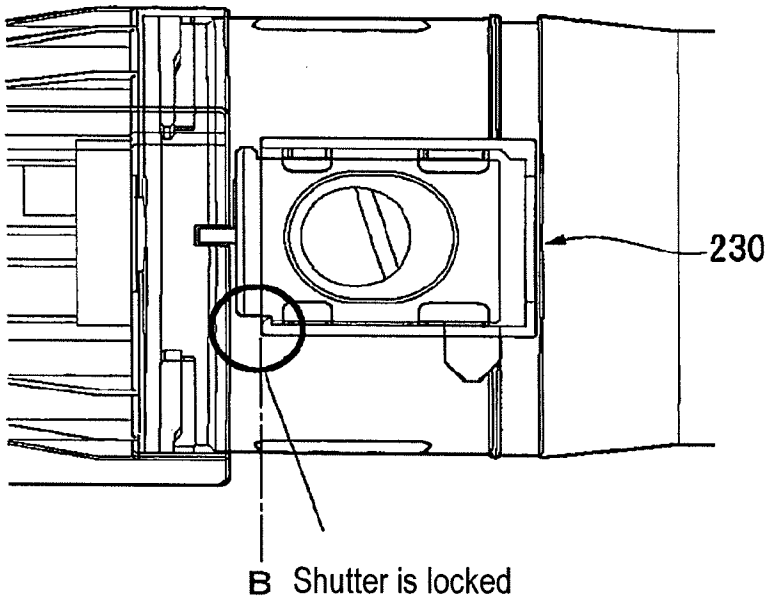
FIG. 14B is an explanatory top view of FIG. 14A.
Figure 14A:
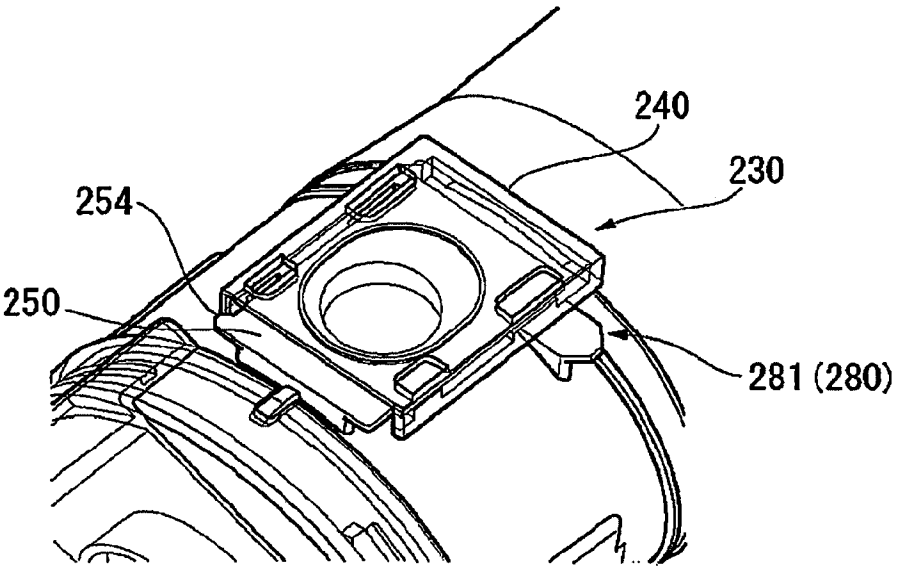
FIG. 14A is a perspective diagram showing a lock state when the opening-and-closing cover of the shutter is located in an intermediate position.

(2) Shutter Lock (FIGS. 14A and 14B)

When the opening-and-closing cover 240 moves in the opening direction from the state of FIGS. 13A and 13B, as shown in FIGS. 14A and 14B, the opening-and-closing cover 240 moves while maintaining the state that the position of the opening-and-closing cover 240 is regulated by the position regulating protrusion 254. Then, the hook claw 244 of the opening-and-closing cover 240 abuts against the blocking portion 253 (see FIG. 17B).

At that moment, since the movement of the opening-and-closing cover 240 is restricted in the intermediate position B, the shutter 230 is locked with respect to the opening-and-closing direction.

For this reason, if the developer storage container 38 is erroneously dropped during an attachment operation of the developer storage container 38 or even if shock absorbing materials such as foamed polystyrene are not filled on both sides of a box-shaped corrugated board during transport, there is little fear of erroneous opening of the shutter 230.

Figure 15B:
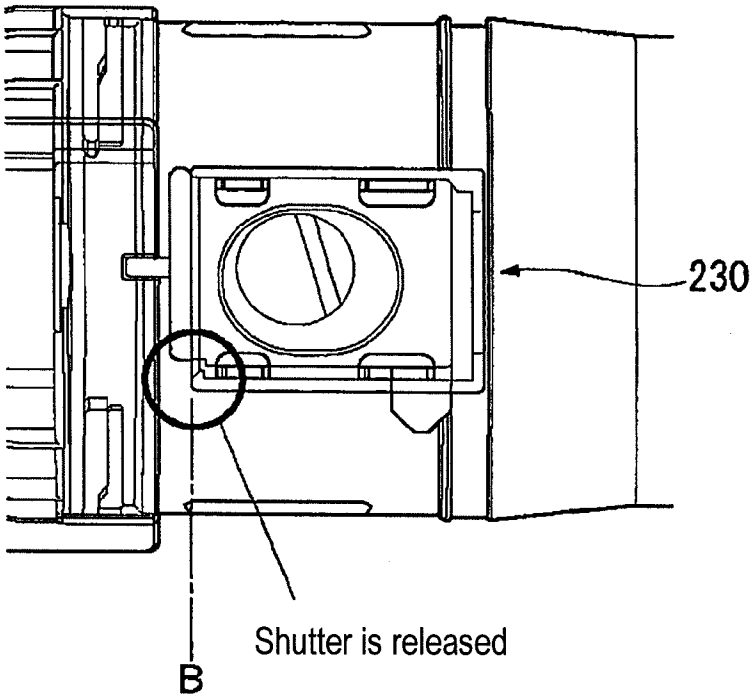
FIG. 15B is an explanatory top view of FIG. 15A.
Figure 15A:
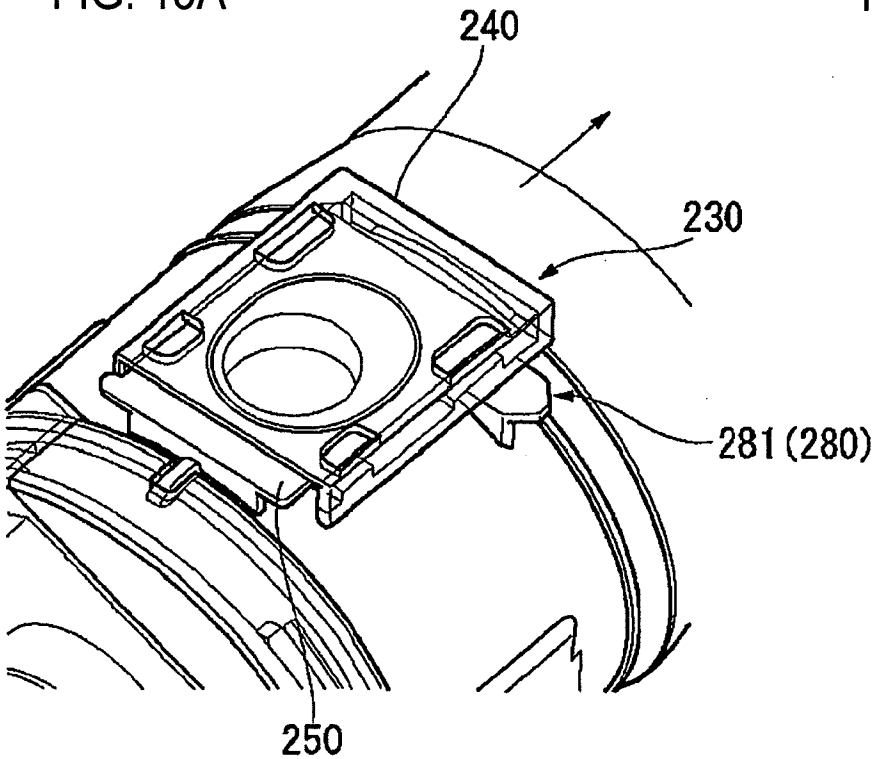
FIG. 15A is a perspective diagram showing a state where the opening-and-closing cover of the shutter has been unlocked.

(3) Shutter Unlock (FIGS. 15A and 15B)

As discussed in Section (2), in the shutter lock state, the side walls 242, in the width direction, of the opening-and-closing cover 240 are moved to a position beyond the position regulating protrusion 254 of the cover holding frame 250. Therefore, the opening-and-closing cover 240 is allowed to move in the width direction intersecting the opening-and-closing direction toward both one edge, in the width direction, of the cover holding frame 250.

Here, the opening-and-closing cover 240 continues to move in the width direction until the disengagement suppressing protrusion 247 formed in the one side wall 242 in the width direction abuts against the reference position of the edge, in the width direction, of the cover holding frame 250.

Figure 18B:
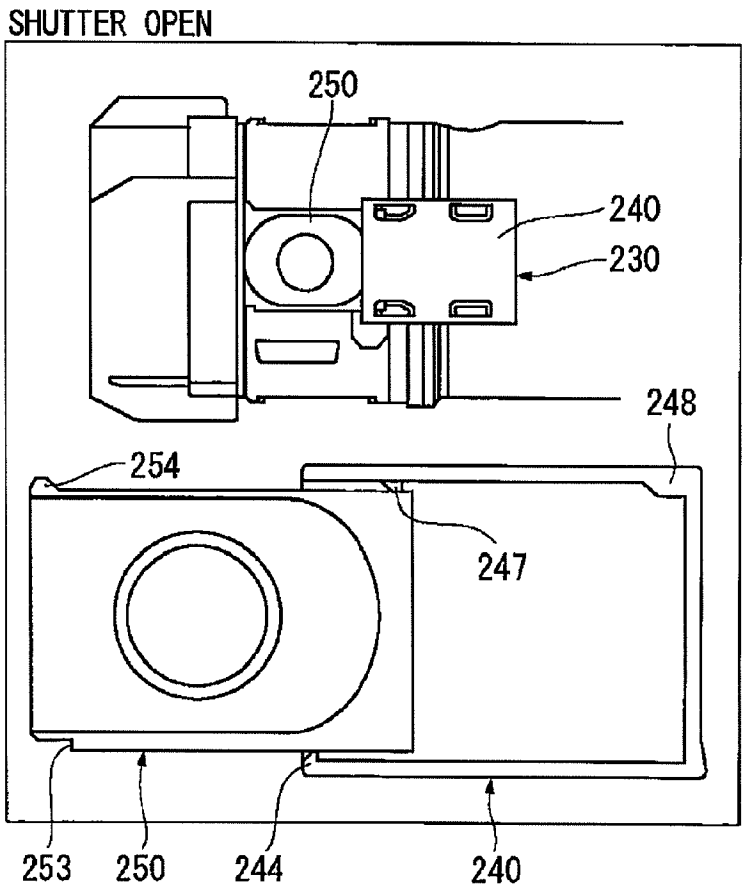
FIG. 18B is an explanatory diagram showing an operation flow of the shutter in which the opening-and-closing cover is located in the opening position.
Figure 18A:
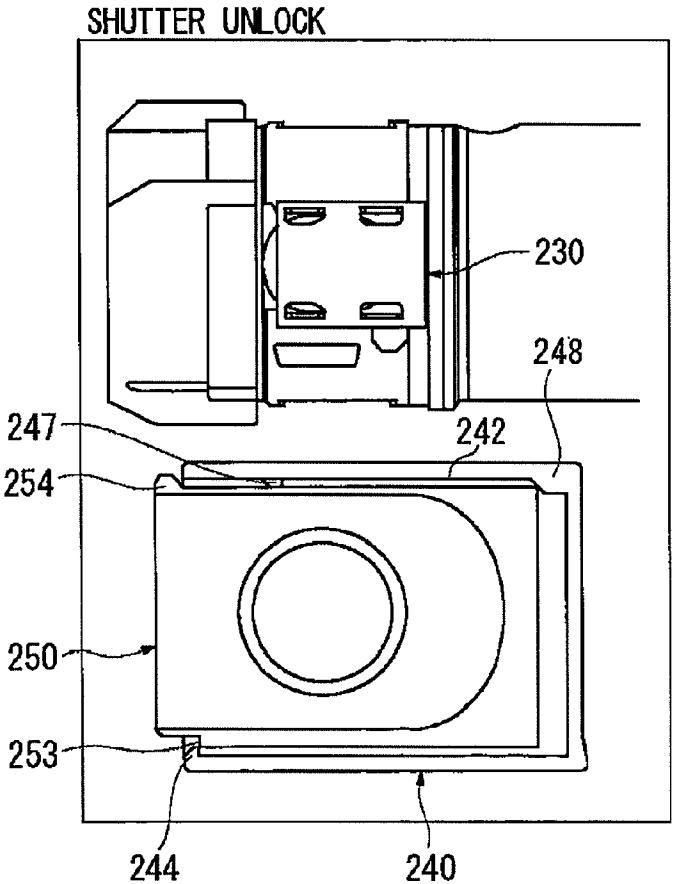
FIG. 18A is an explanatory diagram showing an operation flow of the shutter in which the opening-and-closing cover is in the unlock state.

At this time, as shown in FIG. 18A, the hook claw 244 of the opening-and-closing cover 240 may move from a position where the hook claw 244 is deeply hooked on the blocking portion 253 of the cover holding frame 250 to a position where the hook claw 244 is shallowly hooked on the blocking portion 253. Therefore, in this state, the hook claw 244 can be disengaged from the blocking portion 253 by its elastic deformation. For this reason, the opening-and-closing cover 240 is brought into a state where the opening-and-closing cover 240 is movable with respect to the opening position along the opening-and-closing direction, and the restriction state of the opening-and-closing cover 240 by the blocking portion 253 and the hook claw 244 is released. That is, the shutter 230 is released from a locked state in the opening-and-closing direction, and becomes movable in the opening-and-closing direction.

Figure 16B:
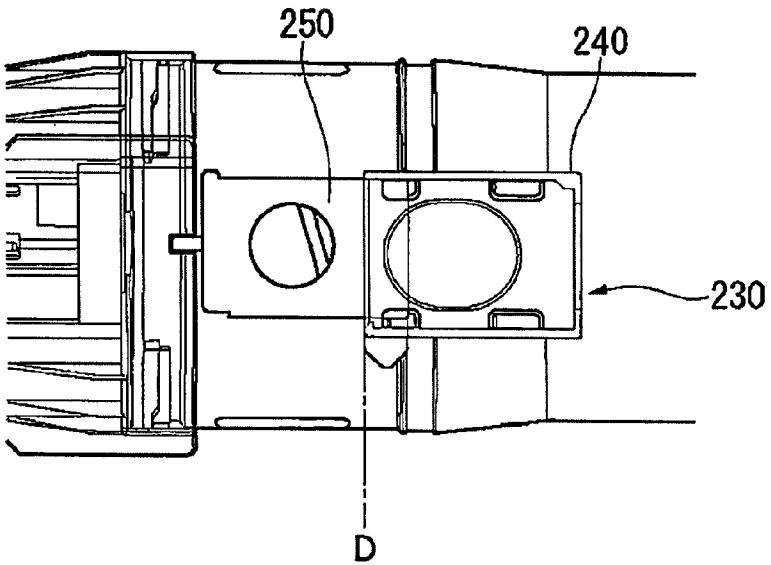
FIG. 16B is an explanatory top view of FIG. 16A.
Figure 16A:
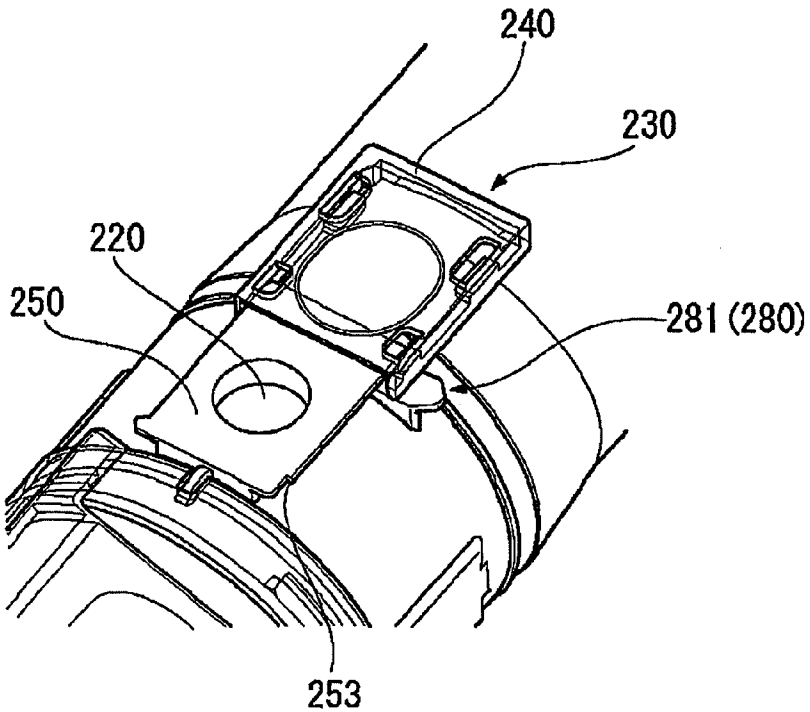
FIG. 16A is a perspective diagram showing a state where the opening-and-closing cover of the shutter is located in an opening position.

(4) Shutter Open (FIGS. 16A and 16B)

As discussed in Section (3), when the shutter 230 is unlocked, the cover 240 is allowed to move in the opening-and-closing direction. Therefore, as shown in FIGS. 16A and 16B, the opening-and-closing cover 240 moves to the opening position D. Thereby, the discharge opening 220 is completely open.

At that moment, as shown in FIG. 18B, since the hook claw 244 of the opening-and-closing cover 240 moves along the edge, in the width direction, of the cover holding frame 250 in an elastic contact state, it does not interfere with the opening operation of the opening-and-closing cover 240. Thus, the opening-and-closing cover 240 moves to an end position (opening position D).

In such a state, in this exemplary embodiment, since there is no biasing force by spring or the like acting between the opening-and-closing cover 240 and the cover holding frame 250, a user can move the opening-and-closing cover 240 without being required to apply a strong force in the opening-and-closing direction.

To the contrary, in a comparative example in which an opening-and-closing cover is elastically held with respect to a cover holding frame by a biasing force of a spring or the like, since a sliding resistance caused by the biasing force of the spring acts between the opening-and-closing cover and the cover holding frame, a non-negligible operation force is required to move the opening-and-closing cover in the opening-and-closing direction.

In another comparative example in which the movement restricting unit is not provided, in order to maintain good closing performance of the opening-and-closing mechanism against impact during an dropping accident or during transport, it is necessary to make the opening-and-closing cover difficult to move by using a thick elastic sealing member so that the opening-and-closing cover won't move in the event of impact during the dropping accident. However, by doing this, it may require a strong operation force in the opening-and-closing direction, although it became able to endure strong impact during dropping accidents.

<Drop Accident and Impact during Transport>

Figure 19:
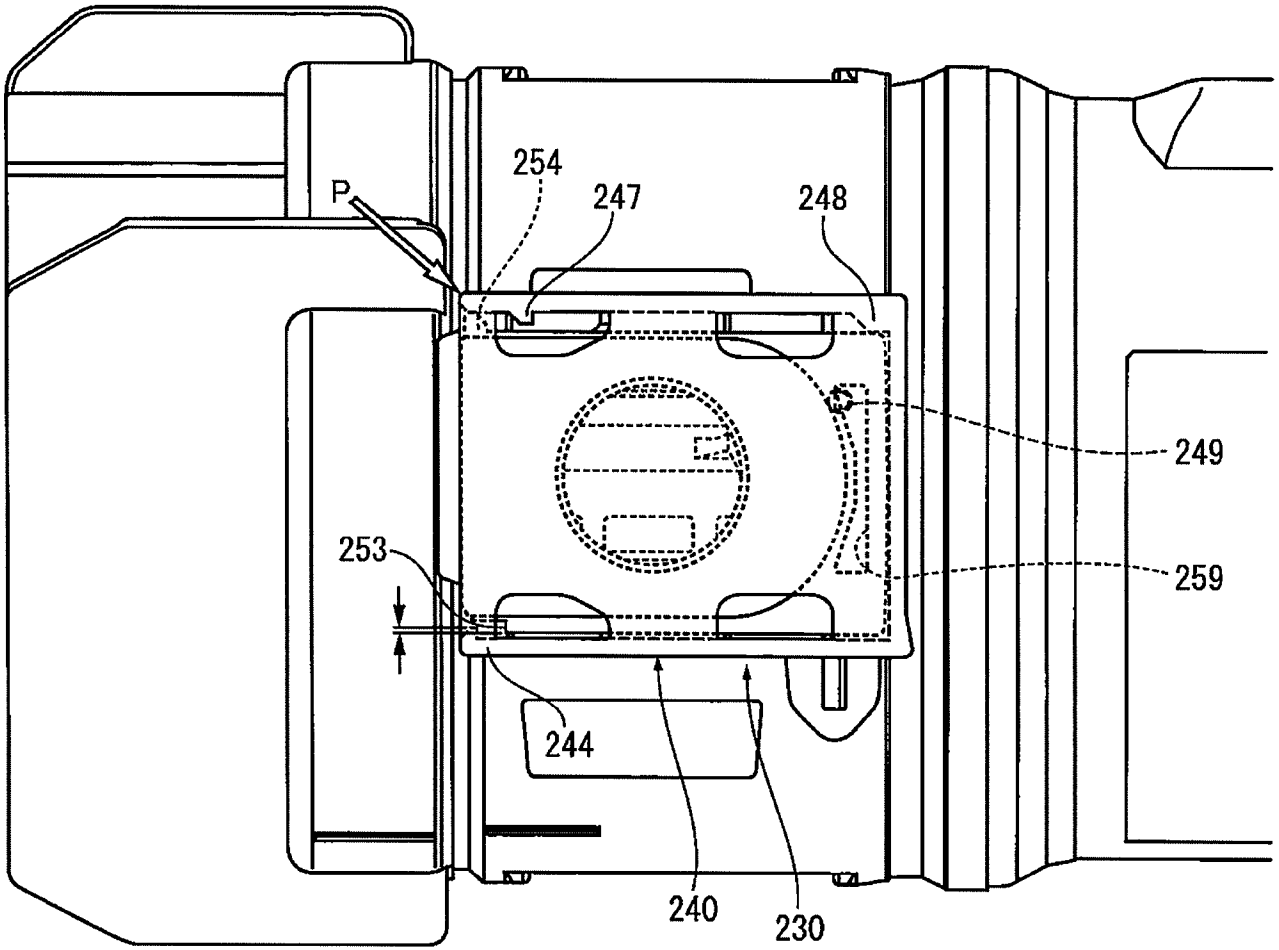
FIG. 19 is an explanatory view showing a state where an impact in a different direction from the opening-and-closing direction acts on the shutter used in the first exemplary embodiment.

As shown in FIG. 19, it is assumed that when the shutter 230 is in the closed state, the opening-and-closing cover 240 is located in the closing position A. Consider that, as shown in FIG. 19, an external force P caused by a drop accident or an impact during transport acts from a direction different from the opening-and-closing direction of the opening-and-closing cover 240.

Figure 20:
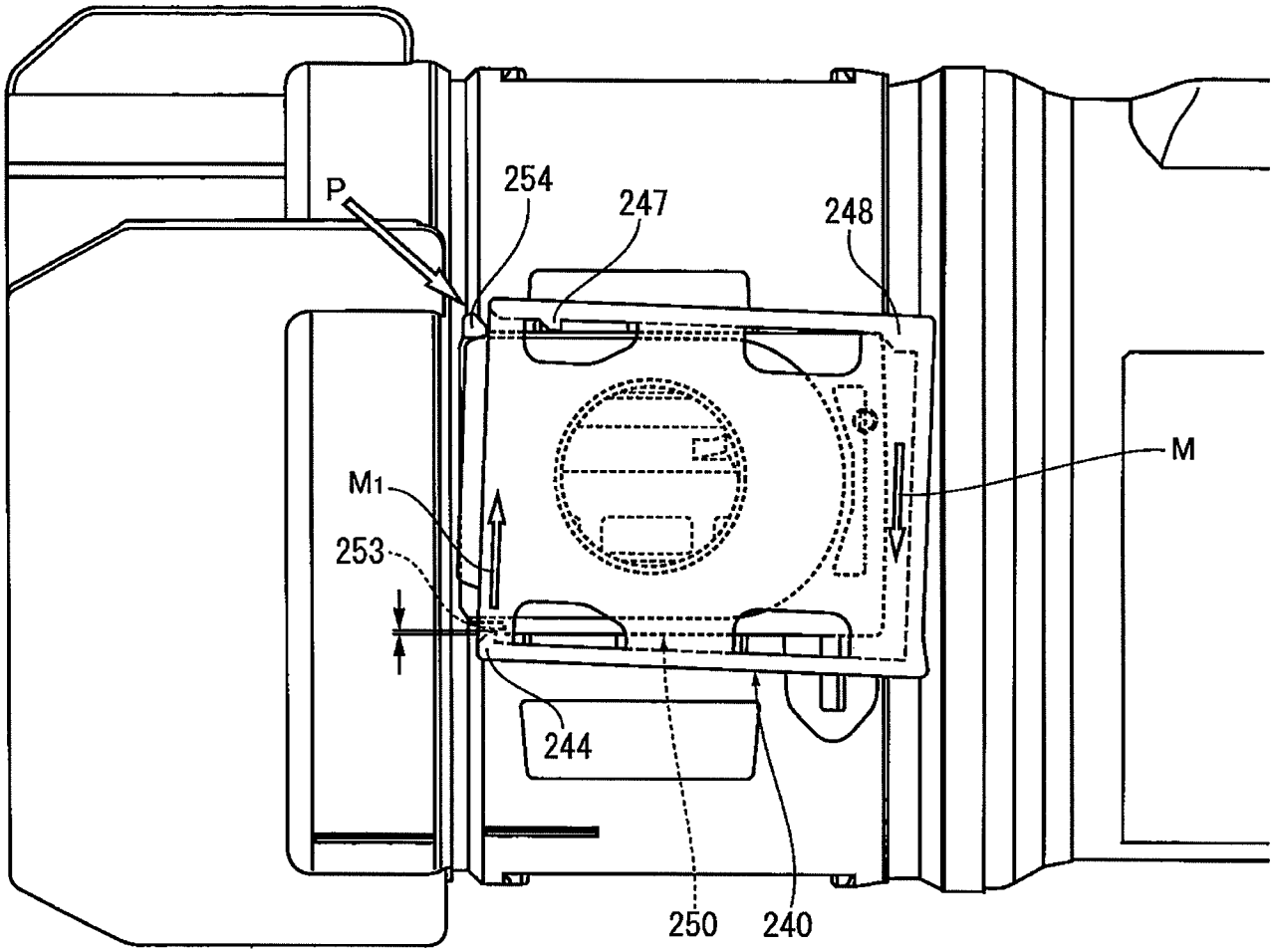
FIG. 20 is an explanatory view showing a behavior of the opening-and-closing cover of the shutter used in the first exemplary embodiment in the state shown in FIG. 19.

At this time, although the external force P has a component along the opening-and-closing direction of the opening-and-closing cover 240 and a component along the width direction, which intersects the opening-and-closing direction, since the movement of the opening-and-closing cover 240 in the width direction is restricted by the position regulating protrusion 254, the opening-and-closing cover 240, as shown in FIG. 20, moves toward the certain intermediate position B from the closing position A along the opening-and-closing direction.

In this state, as shown in FIG. 20, when the opening-and-closing cover 240 reaches a position where the position regulating protrusion 254 is located outside the opening-and-closing cover 240, the disengagement suppressing protrusion 247 of the opening-and-closing cover 240 comes into contact with the cover holding frame 250, and the component of the external force P along the opening-and-closing direction swings with the disengagement suppressing protrusion 247 serving as a fulcrum, and a disengagement suppression moment M is made to act on the opening-and-closing cover 240. This disengagement suppression moment M works so that the hook claw 244 of the opening-and-closing cover 240 is more deeply hooked on the blocking portion 253 of the cover holding frame 250 in a direction $M_1$, and suppresses disengagement of the hook claw 244 from the blocking portion 253.

In particular, in the exemplary embodiment, a gap is secured between the disengagement suppressing protrusion 247 and the position regulating protrusion 254 in the state where the opening-and-closing cover 240 is located in the closing position A. Therefore, a certain amount of moment span exists between the working point of the external force P and the disengagement suppressing protrusion 247, and the disengagement suppression moment M is easily made to act accordingly.

For this reason, even if a drop accident or an impact during transport occurs, there is no concern that the opening-and-closing cover 240 is unnecessarily opened from the cover holding frame 250.

Also, when an external force P caused by the drop accident or the impact during transport acts on the side (hook claw 244 side) opposite to FIG. 19, the external force P is applied in the direction in which the hook claw 244 is deeply hooked on the blocking portion 253. Thus, there is no concern that the opening-and-closing cover 240 is unnecessarily opened from the cover holding frame 250.

Comparative Examples 1 and 2

Here, the influence of the drop accident and the impact during transport is investigated for shutters 230' and 230" of developer storage containers according to Comparative Examples 1 and 2 in order to evaluate the closing performance of the opening-and-closing cover of the developer storage container according to the first exemplary embodiment, and the following results are obtained.

Figure 21B:
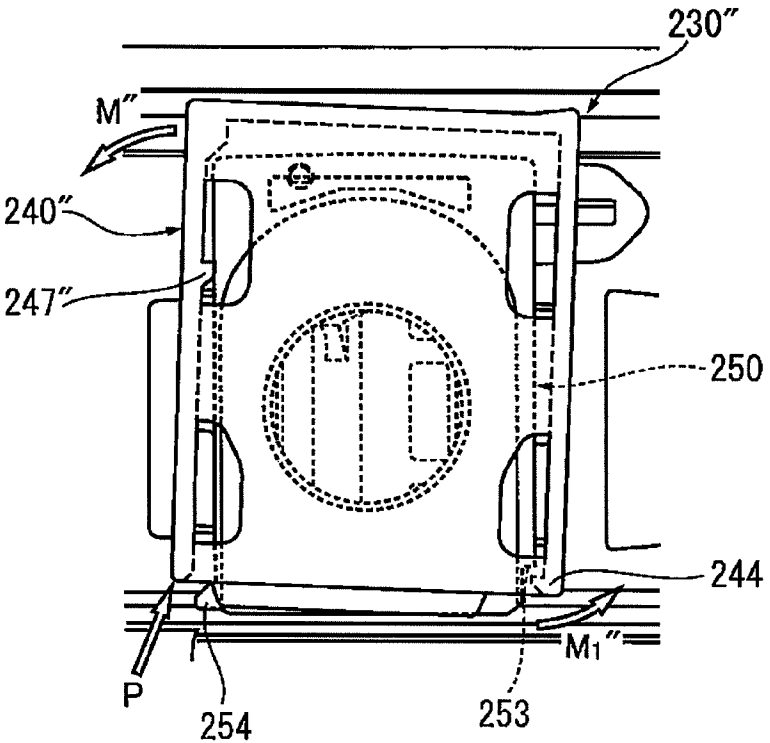
FIG. 21B is an explanatory view showing a behavior of an opening-and-closing cover of a shutter used in a comparative embodiment 2 in a similar situation to that of FIG. 19.
Figure 21A:
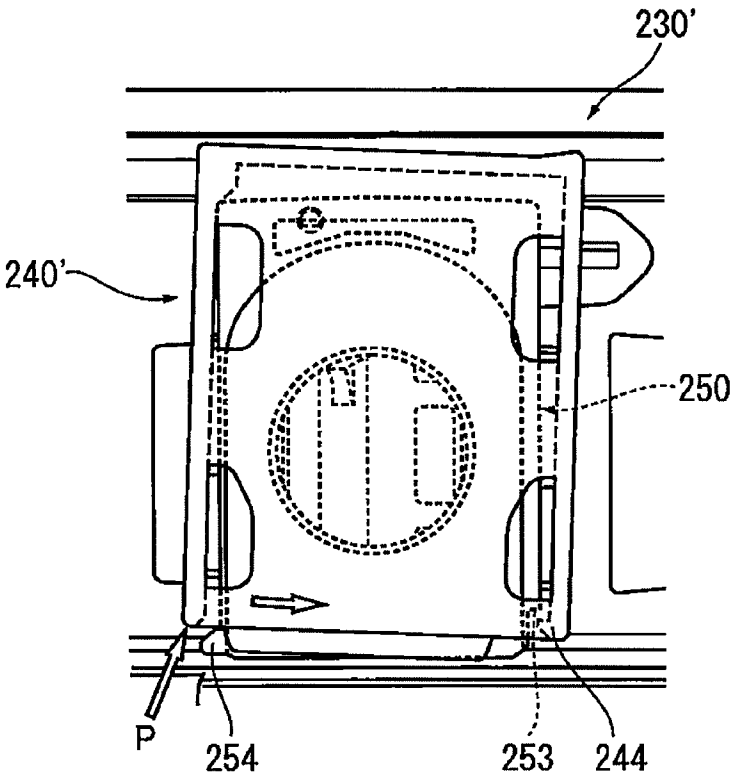
FIG. 21A is an explanatory view showing a behavior of an opening-and-closing cover of a shutter used in a comparative embodiment 1 in a similar situation to that of FIG. 19.

In Comparative Example 1, as shown in FIG. 21A, the opening-and-closing cover 240' which does not have the disengagement suppressing protrusion 247 of the first exemplary embodiment 1 is used.

Meanwhile, in Comparative Example 2, as shown in FIG. 21B, the opening-and-closing cover 240" in which a suppressing protrusion 247" equivalent to the disengagement suppressing protrusion 247 is added to the side apart from the position regulating protrusion 254 is used instead of the disengagement suppressing protrusion 247 of the first exemplary embodiment.

First, in Comparative Example 1, when the opening-and-closing cover 240' reaches a position where the position regulating protrusion 254 is located outside the opening-and-closing cover 240', the disengagement suppressing protrusion 247 is not provided. Therefore, there is a concern that the opening-and-closing cover 240' may move in the direction, which intersects the opening-and-closing direction, straight toward the reference position of the cover holding frame 250. If such a situation occurs, there is concern that the hook claw 244 may be disengaged from the blocking portion 253.

Additionally, in Comparative Example 2, when the opening-and-closing cover 240" reaches a position where the position regulating protrusion 254 is located outside the opening-and-closing cover 240", since the suppressing protrusion 247" is separated from the working point of the external force P of the opening-and-closing cover 240", the component of the external force P of the opening-and-closing cover 240" which intersects the opening-and-closing direction swings with the suppressing protrusion 247" serving as a fulcrum, and a disengagement expediting moment M" opposite to the disengagement suppression moment M of FIG. 20 is made to act on the opening-and-closing cover 240". There is a concern that this disengagement expediting moment M" may work in a direction M1" in which the hook claw 244 of the opening-and-closing cover 240" is disengaged from the blocking portion 253 of the cover holding frame 250, and expedites disengagement of the hook claw 244 from the blocking portion 253.

<Container Receiving Portion>

In this exemplary embodiment, the container receiving portion 100 includes functional portions that enable the opening/closing operation of the shutter 230 via the shutter lock state and the shutter unlock state as described above when the developer storage container 38 is inserted and removed.

Figure 22:
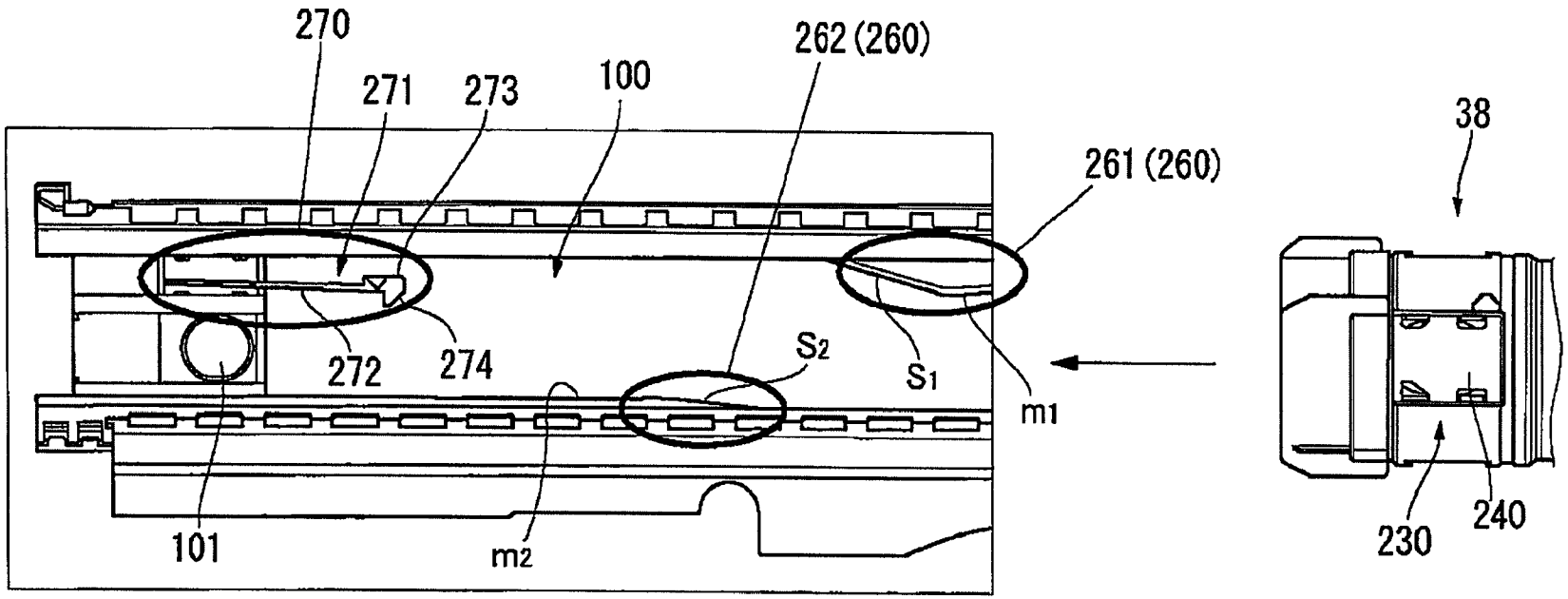
FIG. 22 is an explanatory diagram showing details of the container receiving portion used in the first exemplary embodiment.

In this exemplary embodiment, as shown in FIG. 22, the container receiving portion 100 includes a cover guide rail 260, a movable cover holding mechanism 270 and a cover holding releasing mechanism 280. The cover guide rail 260 guides a movement locus of the opening-and-closing cover 240 of the developer storage container 38. When insertion of the developer storage container 38 is being completed, the movable cover holding mechanism 270 abuts against the opening-and-closing cover 240 so as to move the opening-and-closing cover 240 toward the opening position D and then holds the opening-and-closing cover 240. When the developer storage container 38 is being removed, the movable cover holding mechanism 270 moves the opening-and-closing cover 240, which is located in the opening position D, toward the closing position A. When the developer storage container 38 is being removed, the cover holding releasing mechanism 280 (see FIG. 13) releases the holding state in which the opening-and-closing cover 240 is held by the movable cover holding mechanism 270 at a point of time at which the opening-and-closing cover 240 reaches the closing position A. In FIG. 22, reference numeral 101 designates a through hole connected to the reserve tank 110. FIG. 22 is a schematic view of the container receiving portion 100 and the developer storage container 38 when viewed from the through-hole 101 side.

<Cover Guide Rail>

The cover guide rail 260 has a first guide surface m1 that regulates a position of the side wall 242, in the width direction, of the opening-and-closing cover 240 when the shutter 230 is located in the closing position A in the container receiving portion 100. The cover guide rail 260 includes a first cover guide rail 261 and a second cover guide rail 262. The first cover guide rail 261 releases the regulation caused by the first guide surface m1 in the midway thereof. The second cover guide rail 262 is provided on the inner side than the first cover guide rail 261 and guides the shutter 230 to a second guide surface m2 in which the shutter 230 is moved from the lock position to the unlock position.

In particular, in this exemplary embodiment, the first cover guide rail 261 has an inclined guide surface S1 that extends outward from the end of the first guide surface m1. The second cover guide rail 262 is configured to guide the opening-and-closing cover 240 of the shutter 230 to the second guide surface m2 via an inclined guide surface S2 after the regulation caused by the first guide surface m1 is completely released.

<Movable Cover Holding Mechanism>

The movable cover holding mechanism 270 includes an elastic holding part 271 that is elastically deformable and extends in the opening-and-closing direction of the opening-and-closing cover 240. The elastic holding part 271 is obtained by integrally forming a hook-shaped holding protrusion 273 at a distal end of an elastically deformable plate member 272. Furthermore, at the distal end of the holding protrusion 273, an inclined guide portion 274 is provided which is elastically deformable outward when it abuts against the opening-and-closing cover 240. The elastic holding part 271 having such a configuration abuts against opening-and-closing cover 240 when the developer storage container 38 is being inserted, so as to move the opening-and-closing cover 240 to the opening position D. when the opening-and-closing cover 240 reaches the opening position D, the elastic holding part 271 is elastically deformed outward so as to be apart from the opening-and-closing cover 240, and thereafter the elastic holding part 271 holds the opening-and-closing cover 240 in the opening position D.

<Cover Holding Releasing Mechanism>

The cover holding releasing mechanism 280 (see FIG. 13) includes a holding releasing protruding part 281. When the opening-and-closing cover 240 reaches the closing position A, the holding releasing protruding part 281 (see FIG. 25) elastically deforms the elastic holding part 271 so that the elastic holding part 271 is apart from the opening-and-closing cover 240. The holding state in which the elastic holding part 271 holds the opening-and-closing cover 240 is released by the holding releasing protruding part 281.

In this exemplary embodiment, as shown in FIG. 10 and FIGS. 13 to 16, the holding releasing protruding part 281 is provided in the vicinity of the cover holding frame 250 of the shutter 230. When the developer storage container 38 is being removed from the container receiving portion 100, the holding releasing protrusion part 281 acts on the elastic holding part 271 of the movable cover holding mechanism 270, so as to release the holding state in which the opening-and-closing cover 240 is held by the elastic holding part 271.

<Insertion/Removal Operation Process of Developer Storage Container>

Next, the insertion operation process and removal operation process of the developer storage container will be described with reference to FIGS. 23 to 25. In addition, in FIG. 23 to FIG. 25, in order to show the relative position relation between the container receiving portion 100 and the developer storage container 38, the developer storage container 38 is shown in a transparent manner.

(1) Operation Flow for Insertion of Developer Storage Container (FIGS. 23 and 24)

The shutter 230 operates as follows when the developer storage container 38 is inserted into the container receiving portion 100.

Figure 23B:
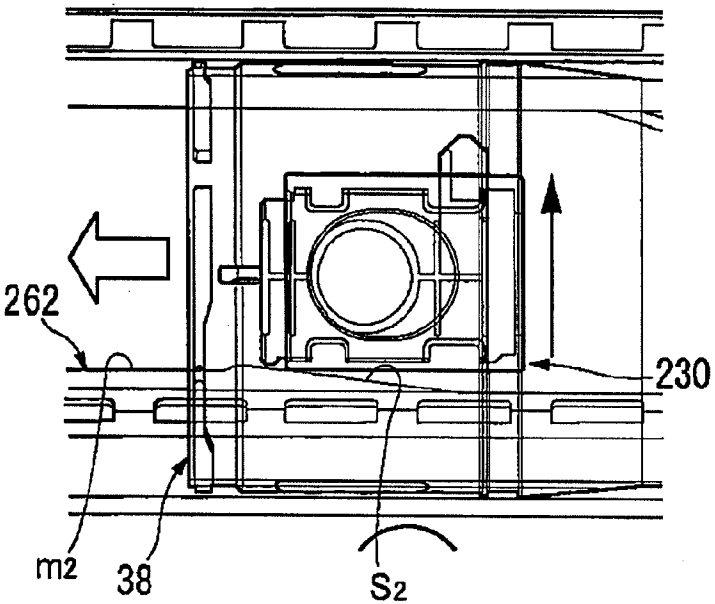
FIGS. 23A and 23B are explanatory diagrams showing an operation flow (1) when the developer storage container is inserted into the container receiving portion of the first exemplary embodiment.
Figure 23A:
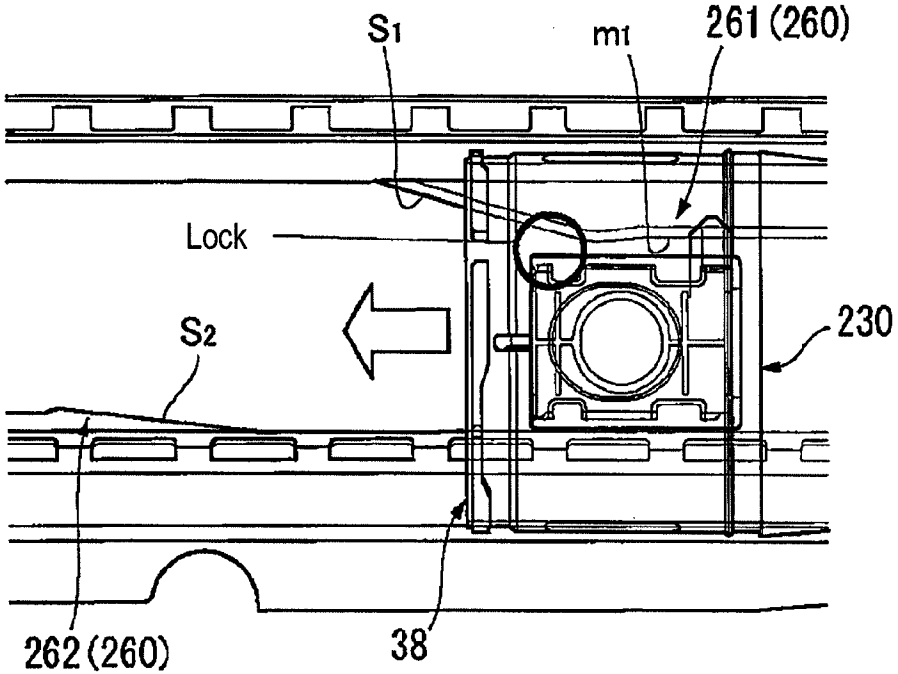
Figures 24A, 24B:
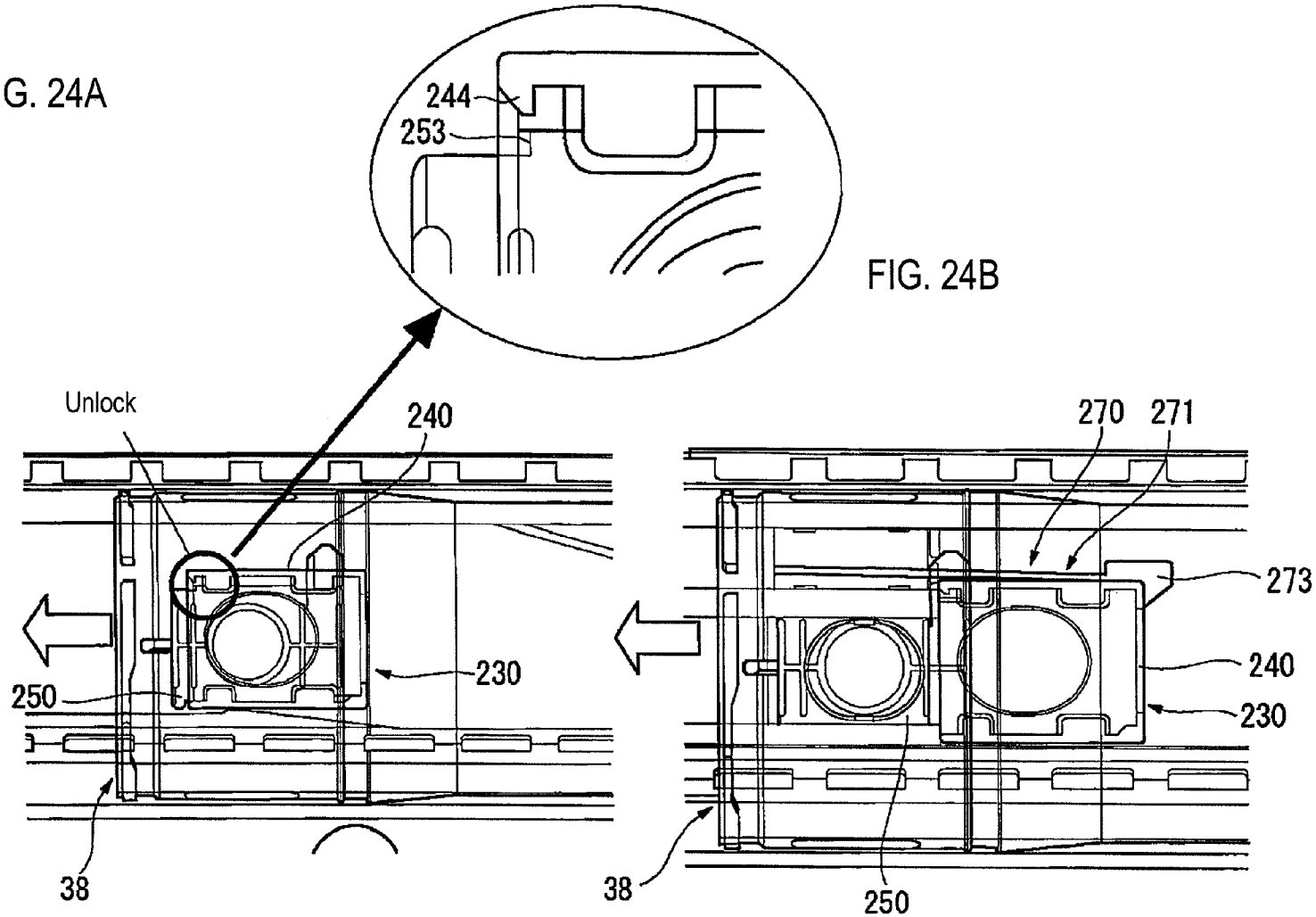
FIGS. 24A and 24B are explanatory diagrams showing an operation flow (2) when the developer storage container is inserted into the container receiving portion of the first exemplary embodiment.

First, the opening-and-closing cover 240 in the closing position A moves while being guided by the cover guide rail 260 (261 and 262), to the intermediate position B in which the opening-and-closing cover 240 enters the unlock state via the lock state as shown in FIGS. 23A, 23B, and 24A. Subsequently, as shown in FIGS. 24A and 24B, the opening-and-closing cover 240 is moved to the opening position D by the elastic holding part 271 of the movable cover holding mechanism 270. Thereafter, the opening-and-closing cover 240 continues moving while pushing the elastic holding part 271 outward until it is held by the elastic holding part 271.

In the meantime, a user in only required to insert the developer storage container 38 into the container receiving portion 100 in the insertion/removal direction. In particular, in this exemplary embodiment, since the insertion/removal direction of the developer storage container 38 is identical to the opening-and-closing direction of the shutter 230, the user need not pay attention to the opening/closing operation of the shutter 230 and the shutter 230 can be set to the opening position D by completing the insertion of the developer storage container 38 into the container receiving portion 100. As a result, the developer is sequentially supplied to the reserve tank 110 from the discharge opening 220 of the developer storage container 38.

(2) Operation Flow for Removal of Developer Storage Container (FIG. 25)

The shutter 230 operates as follows when the developer storage container 38 is removed from the container receiving portion 100.

Figure 25B:
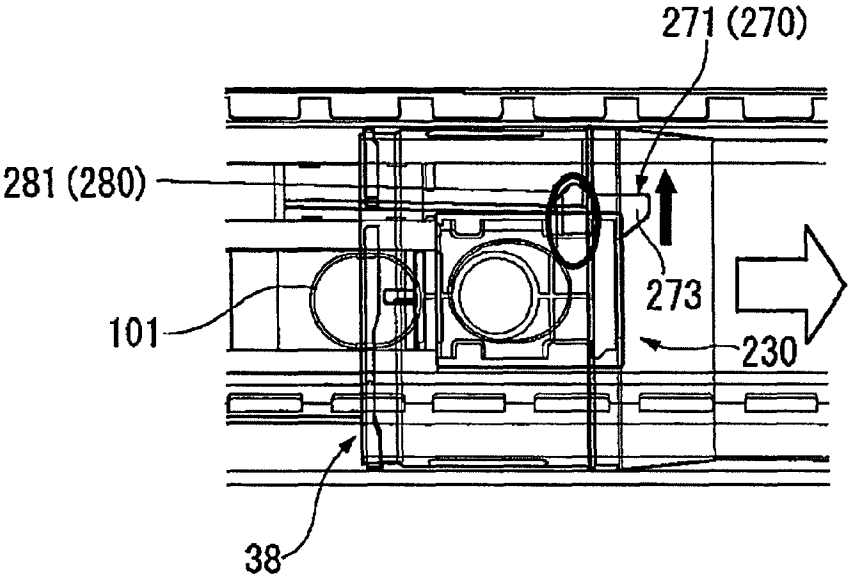
FIGS. 25A and 25B are explanatory diagrams showing an operation flow when the developer storage container is removed from the container receiving portion of the first exemplary embodiment.
Figure 25A:
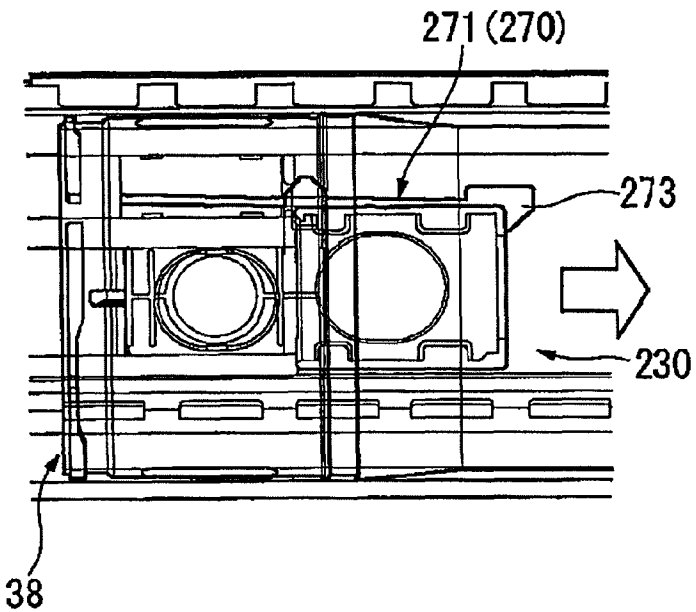

First, as shown in FIGS. 25A and 25B, the opening-and-closing cover 240 is moved to the closing position A by the elastic holding part 271. Thereafter, the holding state in which the opening-and-closing cover 240 is held by the elastic holding part 271 is released by the holding releasing protruding part 281. In such a state, the developer storage container 38 is removed from the container receiving portion 100 in a state where the shutter 230 is located in the closing position A.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A powder storage container that is removably inserted into a container receiving portion of a chassis of an image forming apparatus, the container that stores a powder therein, the container comprising:

a container body that stores the powder therein;

an opening formed in a portion of the container body;

an opening-and-closing cover that blocks the opening;

a cover holding frame that holds the opening-and-closing cover so that the opening-and-closing cover is movable in an opening-and-closing direction between an opening position in which the opening is open and a closing position in which the opening is closed;

a protrusion portion that is provided in the opening-and-closing cover and that protrudes towards the cover holding frame in a direction intersecting the opening-and-closing direction in a state where the opening-and-closing cover is located in the closing position;

a blocking portion that is provided in the cover holding frame, wherein in the state where the opening-and-closing cover is located in the closing position, the blocking portion is located in a position where the blocking portion intersects a straight line which is drawn along the opening-and-closing direction from a distal end position, in a direction perpendicular to the opening-and-closing direction, of the protrusion portion, so that the blocking portion is spaced apart from the protrusion portion, and when the opening-and-closing cover moves in the opening-and-closing direction from the closing position toward the opening position and reaches a certain intermediate position in which it is not started to open the opening, the blocking portion is in contact with the protrusion portion and blocks the protrusion portion of the opening-and-closing cover, which moves toward the opening position, a position regulating protrusion that protrudes from the cover holding frame in a direction which intersects the opening-and-closing direction, wherein when the opening-and-closing cover moves toward the closing position from a position where the protrusion portion and the blocking portion come into contact with each other, the position regulating protrusion comes into contact with the opening-and-closing cover to move the opening-and-closing cover in the direction, which intersects the opening-and-closing direction, and regulates a position of the opening-and-closing cover in the direction intersecting the opening-and-closing direction so that the blocking portion intersects the straight line, which is drawn along the opening-and-closing direction from the distal end position of the protrusion portion; and a disengagement suppressing protrusion that is provided in the opening-and-closing cover on an opposite side to the protrusion portion in the direction, which intersects the opening-and-closing direction of the opening-and-closing cover, wherein in the state where the opening-and-closing cover is located in the closing position, the disengagement suppressing protrusion protrudes from the opening-and-closing cover toward the cover holding frame with a smaller amount of protrusion than the position regulating protrusion, and when the opening-and-closing cover moves along the opening-and-closing direction from the closing position to a position where the position regulating protrusion is located outside the opening-and-closing cover and then moves toward the cover holding frame along the intersection direction, the disengagement suppressing protrusion is in contact with the cover holding frame.

2. The powder storage container according to claim 1, wherein the opening-and-closing cover is swingably supported by a contact portion, serving as a fulcrum, between the disengagement suppressing protrusion and the cover holding frame, and the disengagement suppressing protrusion suppresses a behavior and attitude of the opening-and-closing cover so that when the opening-and-closing cover takes such an attitude that the opening-and-closing cover is arranged along the opening-and-closing operation direction, the distal end position of the protrusion portion is located in a position where the distal end position can be released from the blocking portion, and when the opening-and-closing cover takes such an attitude that the opening-and-closing cover swings so that one side of the opening-and-closing cover which is apart from the fulcrum approaches the cover holding frame, the distal end position of the protrusion portion is located in a position where the blocking portion blocks the distal end position of the protrusion portion.

3. The powder storage container according to claim 1, wherein the powder includes a developer.

4. The powder storage container according to claim 1, wherein the following conditions are satisfied:

$$f>w5-w2$$

$$h>w6-w1$$

$$k>w5-w3$$

where the direction perpendicular to the opening-and-closing direction of the opening-and-closing cover is defined as a width direction, w1 denotes a maximum width of the cover holding frame including a tip of the position regulating protrusion, w2 denote a width from the tip of the position regulating protrusion of the cover holding frame to the blocking portion, w3 denotes a width between both side portions of the cover holding frame excluding the position regulating protrusion, w5 denotes a width from an inner surface of one side wall of the opening-and-closing cover in the width direction to the protrusion portion, w6 denotes a maximum width between both side walls, in the width direction, of the opening-and-closing cover excluding the protrusion portion, f denotes a blocking length of the blocking portion, h denotes a protruding dimension of the protrusion portion, and k denotes a protruding dimension of the position regulating protrusion.

5. The powder storage container according to claim 2, wherein the following conditions are satisfied:

$$f>w5-w2$$

$$h>w6-w1$$

$$k>w5-w3$$

where the direction perpendicular to the opening-and-closing direction of the opening-and-closing cover is defined as a width direction, w1 denotes a maximum width of the cover holding frame including a tip of the position regulating protrusion, w2 denote a width from the tip of the position regulating protrusion of the cover holding frame to the blocking portion, w3 denotes a width between both side portions of the cover holding frame excluding the position regulating protrusion, w5 denotes a width from an inner surface of one side wall of the opening-and-closing cover in the width direction to the protrusion portion, w6 denotes a maximum width between both side walls, in the width direction, of the opening-and-closing cover excluding the protrusion portion, f denotes a blocking length of the blocking portion, h denotes a protruding dimension of the protrusion portion, and k denotes a protruding dimension of the position regulating protrusion.

6. The powder storage container according to claim 1, wherein in the state where the opening-and-closing cover is located at the closing position, the disengagement suppressing protrusion is disposed with a gap between the disengagement suppressing protrusion and the position regulating protrusion.

7. The powder storage container according to claim 2, wherein in the state where the opening-and-closing cover is located at the closing position, the disengagement suppressing protrusion is disposed with a gap between the disengagement suppressing protrusion and the position regulating protrusion.

8. The powder storage container according to claim 4, wherein in the state where the opening-and-closing cover is located at the closing position, the disengagement suppressing protrusion is disposed with a gap between the disengagement suppressing protrusion and the position regulating protrusion.

9. The powder storage container according to claim 5, wherein in the state where the opening-and-closing cover is located at the closing position, the disengagement suppressing protrusion is disposed with a gap between the disengagement suppressing protrusion and the position regulating protrusion.

10. The powder storage container according to claim 1, wherein the opening-and-closing cover is made of an elastic material, and w7<w3 is satisfied, where the direction perpendicular to the opening-and-closing direction of the opening-and-closing cover is defined as a width direction, w3 denotes a width between both side portions of the cover holding frame excluding the position regulating protrusion, and w7 denotes a width from the protrusion portion of the opening-and-closing cover to the disengagement suppressing protrusion.

11. The powder storage container according to claim 2, wherein the opening-and-closing cover is made of an elastic material, and w7<w3 is satisfied, where the direction perpendicular to the opening-and-closing direction of the opening-and-closing cover is defined as a width direction, w3 denotes a width between both side portions of the cover holding frame excluding the position regulating protrusion, and w7 denotes a width from the protrusion portion of the opening-and-closing cover to the disengagement suppressing protrusion.

12. The powder storage container according to claim 4, wherein the opening-and-closing cover is made of an elastic material, and w7<w3 is satisfied, where w7 denotes a width from the protrusion portion of the opening-and-closing cover to the disengagement suppressing protrusion.

13. The powder storage container according to claim 5, wherein the opening-and-closing cover is made of an elastic material, and w7<w3 is satisfied, where w7 denotes a width from the protrusion portion of the opening-and-closing cover to the disengagement suppressing protrusion.

14. The powder storage container according to claim 1, further comprising:

an auxiliary position regulating protrusion that is provided in the opening-and-closing cover, wherein in the state where the opening-and-closing cover is located in the closing position, the auxiliary position regulating protrusion is in contact with the cover holding frame with a protrusion amount equal to that of the position regulating protrusion and regulates the position of the opening-and-closing cover in the direction, which intersects the opening-and-closing direction.

15. The powder storage container according to claim 2, further comprising:

an auxiliary position regulating protrusion that is provided in the opening-and-closing cover, wherein in the state where the opening-and-closing cover is located in the closing position, the auxiliary position regulating protrusion is in contact with the cover holding frame with a protrusion amount equal to that of the position regulating protrusion and regulates the position of the opening-and-closing cover in the direction, which intersects the opening-and-closing direction.

16. The powder storage container according to claim 4, further comprising:

an auxiliary position regulating protrusion that is provided in the opening-and-closing cover, wherein in the state where the opening-and-closing cover is located in the closing position, the auxiliary position regulating protrusion is in contact with the cover holding frame with a protrusion amount equal to that of the position regulating protrusion and regulates the position of the opening-and-closing cover in the direction, which intersects the opening-and-closing direction.

17. The powder storage container according to claim 5, further comprising:

an auxiliary position regulating protrusion that is provided in the opening-and-closing cover, wherein in the state where the opening-and-closing cover is located in the closing position, the auxiliary position regulating protrusion is in contact with the cover holding frame with a protrusion amount equal to that of the position regulating protrusion and regulates the position of the opening-and-closing cover in the direction, which intersects the opening-and-closing direction.

18. The powder storage container according to claim 6, further comprising:

an auxiliary position regulating protrusion that is provided in the opening-and-closing cover, wherein in the state where the opening-and-closing cover is located in the closing position, the auxiliary position regulating protrusion is in contact with the cover holding frame with a protrusion amount equal to that of the position regulating protrusion and regulates the position of the opening-and-closing cover in the direction, which intersects the opening-and-closing direction.

19. The powder storage container according to claim 7, further comprising:

an auxiliary position regulating protrusion that is provided in the opening-and-closing cover, wherein in the state where the opening-and-closing cover is located in the closing position, the auxiliary position regulating protrusion is in contact with the cover holding frame with a protrusion amount equal to that of the position regulating protrusion and regulates the position of the opening-and-closing cover in the direction, which intersects the opening-and-closing direction.

20. An image forming apparatus comprising:

a chassis of the chassis of the image forming apparatus formed with a container receiving portion, and the powder storage container according to claim 1, wherein the container receiving portion of the chassis of the image forming apparatus includes a cover guide rail that guides the opening-and-closing cover of the powder storage container, a cover holding mechanism, and a cover-holding releasing mechanism, when the powder storage container is being inserted, the cover holding mechanism abuts against the opening-and-closing cover to move the opening-and-closing cover toward the opening position and then holds the opening-and-closing cover, when the powder storage container is being removed, the cover holding mechanism moves the opening-and-closing cover, which is located in the opening position, toward the closing position, and when the powder storage container is being removed and the opening-and-closing cover reaches the closing position, the cover-holding releasing mechanism releases a state in which the cover holding mechanism holds the opening-and-closing cover.

* * * * *